US005825384A

United States Patent [19]

Fujita

[11] Patent Number: 5,825,384

[45] Date of Patent: Oct. 20, 1998

[54] IMAGE FORMING APPARATUS INCLUDING MEANS FOR CONTROLLING THE FLIGHT OF TONER OR VISUALIZING PARTICLES IN ACCORDANCE WITH AN IMAGE SIGNAL

[75] Inventor: Hirokazu Fujita, Nara, Japan

[73] Assignee: Sharp Kabushiki Kaisha, Osaka, Japan

[21] Appl. No.: 715,514

[22] Filed: Sep. 18, 1996

[30] Foreign Application Priority Data

Sep. 22, 1995 [JP] Japan ..... 7-244790
Sep. 22, 1995 [JP] Japan ..... 7-244803

[51] Int. Cl.[6] ..... B41J 2/06; G03G 15/06; G03G 15/08

[52] U.S. Cl. ..... 347/55; 399/55; 399/291

[58] Field of Search ..... 347/55, 131, 125, 347/158; 399/291, 293

[56] References Cited

U.S. PATENT DOCUMENTS

| | | | |
|---|---|---|---|
| 4,751,532 | 6/1988 | Fujimura et al. | 347/55 |
| 4,860,036 | 8/1989 | Schmidlin | 347/55 |
| 5,036,341 | 7/1991 | Larsson | 347/55 |
| 5,095,322 | 3/1992 | Fletcher | 347/55 |
| 5,128,695 | 7/1992 | Maeda | 347/55 |
| 5,214,451 | 5/1993 | Schmidlin et al. | 347/55 |
| 5,329,307 | 7/1994 | Takemura et al. | 347/151 |
| 5,374,949 | 12/1994 | Wada et al. | 347/112 |
| 5,404,155 | 4/1995 | Kitamura | 347/55 X |
| 5,477,250 | 12/1995 | Larson | 347/55 |
| 5,497,175 | 3/1996 | Maeda | 347/55 |
| 5,504,509 | 4/1996 | Kagayama | 347/55 |
| 5,523,777 | 6/1996 | Kitamura | 347/55 |
| 5,614,932 | 3/1997 | Kagayama | 347/55 |
| 5,625,392 | 4/1997 | Maeda | 347/55 |
| 5,659,344 | 8/1997 | Kagayama | 347/55 |
| 5,708,464 | 1/1998 | Desie | 347/55 |

FOREIGN PATENT DOCUMENTS

| | | |
|---|---|---|
| A-4038083 | 6/1991 | Germany . |
| A4338992 | 5/1994 | Germany . |

OTHER PUBLICATIONS

Published Unexamined Japanese Patent Application No. 104769/1983, Published Jun., 1983.
Published Unexamined Japanese Patent Application No. 3972/1994, Published Jan., 1994.

*Primary Examiner*—S. Lee
*Attorney, Agent, or Firm*—David C. Conlin; William J. Daley, Jr.

[57] ABSTRACT

An image forming apparatus of the present invention includes a toner carrier, a counter electrode, and a control electrode, which have the same potential as a ground potential of the image forming apparatus during a non-operational period while a flight electric field-use operational voltage and control voltages are not applied. During an operational period while the operational voltage and the control voltages are applied, a flight suppressing voltage for suppressing flight of the toner in the control voltages is first applied to the control voltage, and thereafter the operational voltage is applied to the counter electrode. When the application of the operational voltage and the control voltage are suspended, the flight suppressing voltage is first applied as the control voltage, then the application of the operational voltage is suspended, and thereafter the application of the flight suppressing voltage is suspended. With the control thus carried out, the flight of unnecessary toner is suppressed, thereby ensuring that images of high quality are obtained.

22 Claims, 36 Drawing Sheets

$E_1$: BIAS POTENTIAL OF TONER CARRIER
$E_2$: OPERATING POTENTIAL OF COUNTER ELECTRODE
GND: GROUND POTENTIAL OF IMAGE FORMING APPARATUS

IMAGE FORMING APPARATUS INCLUDING MEANS FOR CONTROLLING THE FLIGHT OF TONER OR VISUALIZING PARTICLES IN ACCORDANCE WITH AN IMAGE SIGNAL

FIELD OF THE INVENTION

The present invention relates to an image forming apparatus, such as a printing apparatus, a printer, a copying machine, and a facsimile, for forming a visible image on a recording medium such as paper in accordance with an image signal.

BACKGROUND OF THE INVENTION

Conventionally, a xerography has been well-known as a method for forming an image in accordance with an image signal on paper as a recording medium. According to this method, an electrostatic pattern is formed by an optical writing means on a photoreceptor, namely, a visualizer having electrical-optical properties, and the electrostatic pattern thus formed is visualized with toner which is visualizing particles. The image thus visualized is transferred to a sheet of paper. Thus, a visible image is obtained on a sheet.

The following description will concretely depict the above operation of obtaining a visible image. An image electric signal is converted into a light signal by the above-mentioned optical writing means, which is a light generating apparatus such as a semiconductor laser or an LED (light emitting diode). The light signal is projected on the photoreceptor which has been uniformly charged, so that the electrostatic pattern according to light intensity is formed on the surface of the photoreceptor. In the next stage, charged toner is caused to contact with or fly to the electrostatic pattern so that the image is visualized, thereby forming a toner image. The toner image is transferred to the sheet of paper by electrical force, pressure, or both of them. Then, the toner image on the sheet is fixed thereon by pressure, heat, or both of them.

There is another conventional image forming method which utilizes a charged particle generator, charged particle current control grids, and a dielectric drum as a latent image forming device. According to this method, voltages to be applied to the charged particle current control grids is controlled according to image signals, and a charged particle current from the charged particle generator to the dielectric drum is controlled according to the voltages, thereby causing a charge pattern to be formed on the dielectric drum in accordance with the image signals. The charge pattern is visualized with toner, thereby becoming a toner image. The toner image is transferred to a sheet by electric force, pressure, or both of them, and the toner image on the sheet is fixed thereon by pressure, heat, or both of them.

By the described method, after an electrostatic latent image in accordance with image signals is once formed on the latent image forming device, the electrostatic latent image is visualized with toner so that a toner image is formed on the latent image forming device. Therefore, a latent image forming device with a special structure and a writing means for writing an electrostatic latent image are required. Moreover, when the latent image forming device is used for plural times, an erasing means for erasing a previously written electrostatic latent image is required in addition to the writing means. Furthermore, the process for obtaining an image is complicated since a toner image formed on the latent image forming device is transferred to a sheet, thereby causing it difficult to miniaturize an image forming apparatus and to stably obtain a satisfactory image.

Meanwhile, PCT Unexamined Patent Publication No. 1-503221/1989 (Tokuhyohei 1-503221) discloses a direct printing method as a method whereby the above problems are solved. By the method, a toner image is directly formed on a sheet, by applying voltages corresponding to image signals to the charged particle current control grids and causing charged toner to selectively fly from a toner carrier to a counter electrode. The toner image is fixed on the sheet by pressure, heat, or both of them. Such a method, without use of the previously-mentioned latent image forming device, simplifies the image forming process, enables miniaturization of an image forming apparatus, and ensures that satisfactory images are stably obtained.

The arrangement of the apparatus disclosed in the above publication, however, is proposed without sufficient consideration to control of the flight of toner from the toner carrier in the direction to the counter electrode. Therefore, optimal control of the flight of toner cannot be achieved, thereby resulting in that satisfactory images cannot be obtained.

Furthermore, the arrangement of the apparatus disclosed in the above publication is proposed without sufficient consideration to preventing distortion of the toner image which is formed on the sheet with toner having flown from the toner carrier. Therefore, the apparatus is unable to properly keep toner on the sheet, thereby presenting a problem that satisfactory images cannot be obtained.

SUMMARY OF THE INVENTION

The object of the present invention is to provide an image forming apparatus which can control the flight of toner so that the toner appropriately flies from a toner carrier to a counter electrode, and prevent distortion of toner images which is formed on a sheet of paper by the toner having flown from the toner carrier, so that images of high quality can be obtained.

In order to achieve the above object, the image forming apparatus of the present invention comprises:

- a visualizing particle carrier for carrying visualizing particles;
- a counter electrode provided vis-a-vis the visualizing particle carrier;
- a control electrode provided between the visualizing particle carrier and the counter electrode;
- power supply means for applying a flight electric field-use voltage across the visualizing particle carrier and the counter electrode so that an electric field for causing the visualizing particles to fly from the visualizing particle carrier toward the counter electrode is generated;
- control voltage applying means for applying a control voltage to the control electrode so that the flight of the visualizing particles is controlled in accordance with an image signal;
- a recording medium transport route through which a recording medium is transported while being in contact with the counter electrode, the visualizing particles adhering to the recording medium transport route; and
- control means for controlling the power supply means and control voltage applying means, so that:
  - during a non-operational period while the flight electric field-use voltage and the control voltage are not applied, the visualizing particle carrier, the counter electrode, and the control electrode have the same potential as a ground potential of the image forming apparatus;
  - during an operational period while the flight electric field-use voltage and the control voltage are applied, a flight suppressing voltage in the control voltages is first applied to the control electrode, the flight suppressing voltage for suppressing the flight of the visualizing particles, and thereafter the flight electric field-use voltage is applied across the visualizing particle carrier and the counter electrode; and when the application of the flight electric field-use voltage and the control voltage is suspended, the flight suppressing voltage as the control voltage is applied to the control electrode, then the application of the flight electric field-use voltage is suspended, and thereafter the application of the flight suppressing voltage is suspended.

With the described arrangement, the flight electric field-use voltage applied by the power supply means to the visualizing particles carrier and the counter electrode generates, between the visualizing particle carrier and the counter electrode, the electric field which causes the visualizing particles to fly, and the visualizing particles are caused by the electric field to fly from the visualizing particle carrier to the counter electrode. The flight of the visualizing particles is controlled by the control voltages in accordance with the image signals. As a result, visualizing particle images are formed in accordance with image signals, on a recording medium transported through the recording medium transport route.

It is also arranged that during a non-operational period while neither the flight electric field-use voltage nor control voltages are not applied, for example, during a stand-by period, the visualizing particle carrier, the counter electrode, and the control electrode have the same potential as the ground potential of the image forming apparatus, the ground potential being a potential of a grounded terminal in the image forming apparatus. Therefore, the potential relation between the three members can be kept stable, and the following problems are prevented: the visualizing particles fly from the visualizing particle carrier and scatter, thereby dirtying the inside of the image forming apparatus; the scattering visualizing particles adhering to the control electrode and the counter electrode cause the potentials of the same to become unstable, thereby resulting in that the image forming operation is adversely affected, and further worse, the control of the visualizing particles' flight becomes impossible; and, visualizing particles adhering to the counter electrode dirty recording media.

Furthermore, during the operational period while the flight electric field-use voltage and the control voltages are applied, for example, during the image formation, the flight suppressing voltage for suppressing the flight of visualizing particles, in the control voltages is first applied to the counter electrode, and thereafter the flight electric field-use voltage is applied to the visualizing particle carrier and the counter electrode. With the voltage applying steps in this order, adhesion of unnecessary visualizing particles to the recording medium is prevented.

On the other hand, when, for example, the image formation ends and the application of the flight electric field-use voltage and control voltages is suspended, the flight suspending voltage in the control voltages is applied with the application of the other control voltages suspended, then the application of the flight electric field-use voltage is suspended, and thereafter the application of the flight suppressing voltage is suspended. With these voltage applying steps in this order, adhesion of unnecessary visualizing particles to the recording medium is prevented. As a result, images of high quality are obtained.

Another image forming apparatus of the present invention comprises:

a visualizing particle carrier for carrying visualizing particles;

a control electrode provided so as to face the visualizing particle carrier;

a counter electrode provided so as to face the visualizing particle carrier, with the control electrode provided between the visualizing particle carrier and the counter electrode, the counter electrode including an extension section extending in a recording medium transport direction at least on a downstream side of a portion of the counter electrode facing an image forming region where the visualizing particles fly from the visualizing particle carrier under the control of the control electrode;

power supply means for applying a flight electric field-use voltage across the visualizing particle carrier and the counter electrode so that an electric field for causing the visualizing particles to fly from the visualizing particle carrier toward the counter electrode is generated;

control voltage applying means for applying a control voltage to the control electrode so that the flight of the visualizing particles is controlled in accordance with an image signal;

a recording medium transport route through which a recording medium is transported while being in contact with the counter electrode, the recording medium transport route being provided between the control electrode and the counter electrode, the visualizing particles adhering to the recording medium; and fixing means for fixing the visualizing particles on the recording medium, the fixing means being provided on a downstream side of the recording medium transport direction in the recording medium transport route.

According to the described arrangement, during the image formation, a voltage applied by the power supply means across the visualizing particle carrier and the counter electrode causes, between the visualizing particle carrier and the counter electrode, the electric field which causes the visualizing particles to fly, and the electric field causes the visualizing particles to fly from the visualizing particle carrier toward the counter electrode. The flight of the visualizing particles is controlled by the control voltages applied to the control electrode in accordance with the image signals. As a result, visualizing particle images are formed in accordance with image signals, on a recording medium transported through the recording medium transport route.

The visualizing particles on the recording medium is maintained thereon by electric charges of the visualizing particles and electric charges supplied from the counter electrode to the rear surface of the recording medium when these electric charges equilibrate. Therefore, when electric charges are insufficiently supplied to the recording medium, the visualizing particles are unstably maintained on the recording medium. This leads to distortion of visualizing particle images, that is, distortion of recorded images, when the visualizing particles are affected by electric fields around the recording medium or are affected by shocks.

In order to comply with the above problem, the counter electrode of the image forming apparatus of the present invention has the extension section extending in a recording medium transport direction at least on the downstream side of the portion facing the image forming region, so that the supply of electric charges from the counter electrode to the recording medium is carried out for a longer period. Therefore, with increased supply of electric charges to the recording medium, movements of visualizing particles on the recording medium are suppressed, thereby resulting in that images of high quality are obtained.

For fuller understanding of the nature and advantages of the invention, reference should be made to the ensuing detailed description taken in conjunction with the accompanying drawings.

DESCRIPTION OF THE PREFERRED EMBODIMENTS

[First Embodiment]

The following description will explain one embodiment of the present invention referring to FIGS. 1 through 11.

Figure 2:
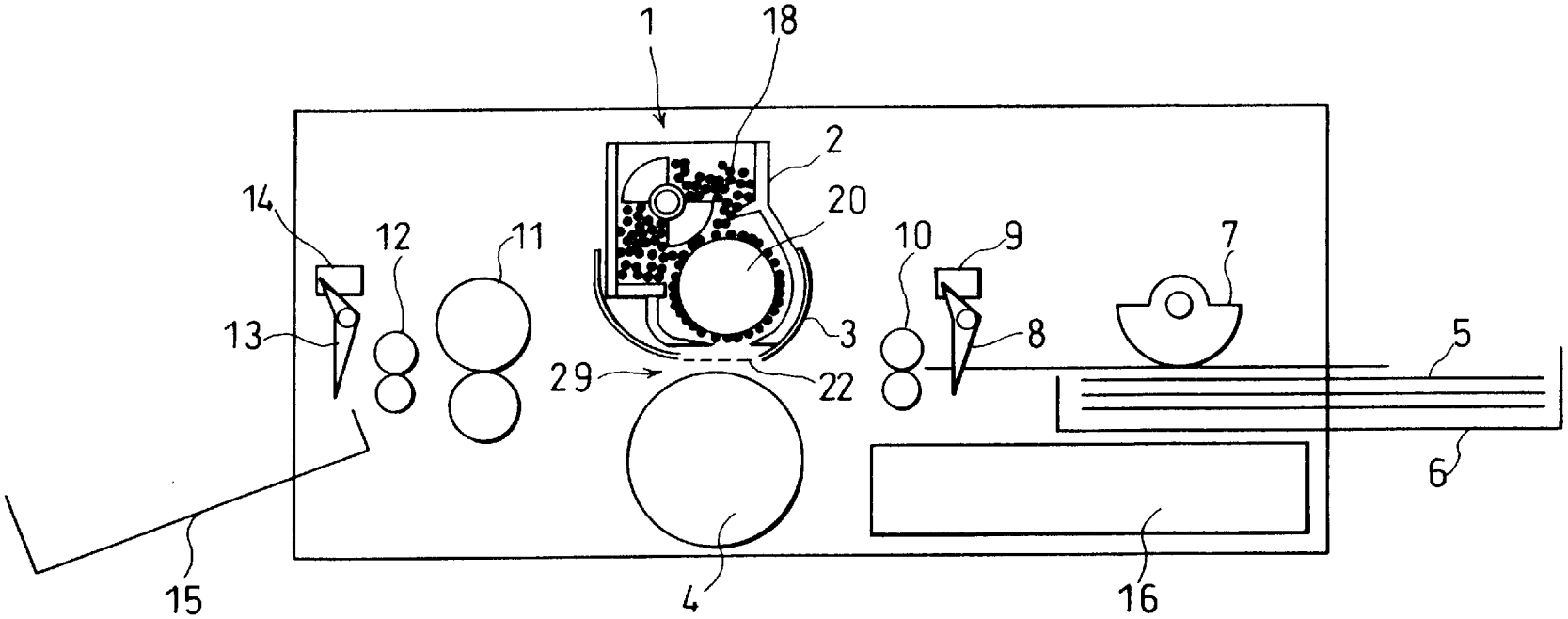
FIG. 2 is a schematic front view illustrating the arrangement of the whole image forming apparatus.

As shown in FIG. 2, an image forming apparatus of the present embodiment includes an image forming unit 1 provided with a toner supplying part 2, an image forming head 3, and a counter electrode 4. The image forming unit 1 forms an image in accordance with image signals on a sheet 5 which is a recording medium, by using toner 18 which is visualizing particles.

On a sheet feeding side of the image forming unit 1, there are provided a sheet cassette 6, a feed roller 7, a sheet detecting member 8, a feeding sensor 9, a register roller 10, and a control unit 16 as controlling means for controlling the image forming apparatus in whole. On a sheet discharging side of the image forming unit 1, there are provided a fixing part 11, a discharge roller 12, a sheet detecting member 13, a discharge sensor 14, and a discharge tray 15.

The sheet 5, stored in the sheet cassette 6, is fed from the sheet cassette 6 by the feed roller 7, and activates the sheet detecting member 8 to move. With the motion of the sheet detecting member 8, the feeding sensor 9 detects that the sheet 5 is fed. The register roller 10 transports the sheet 5, which has been thus supplied from the sheet cassette 6, to the image forming unit 1 at a predetermined timing. A toner image formed on the sheet 5 at the image forming unit 1 is fixed thereon by fixing part 11, by using heat, pressure, or both of them. The sheet 5 thus processed by the fixing part 11 is discharged by the discharge roller 12 to the discharge tray 15, and activates the sheet detecting member 13 to move. With the motion of the sheet detecting member 13, the discharge sensor 14 detects that the sheet 5 is discharged. The discharge tray 15 receives the discharged sheet 5.

Figure 3:
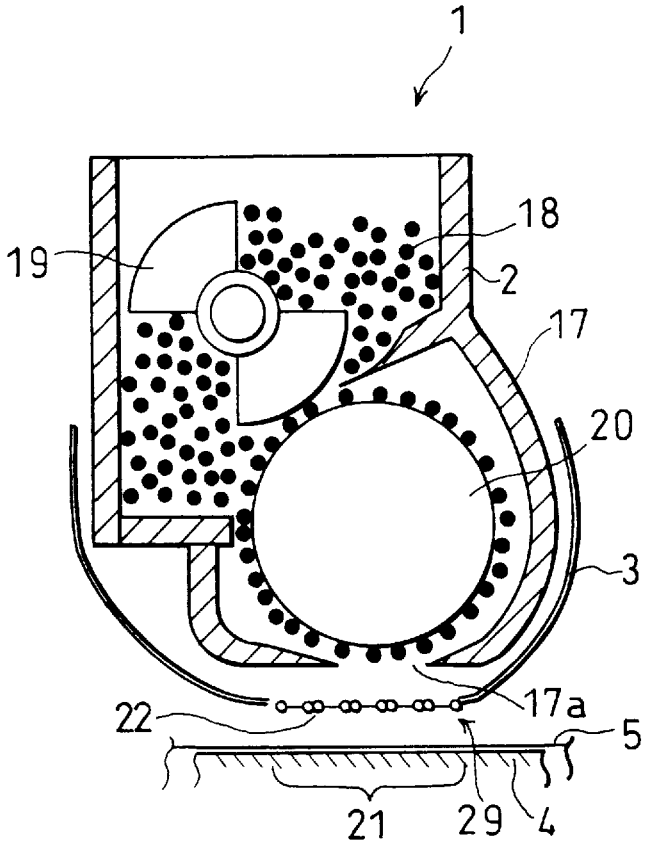
FIG. 3 is an enlarged view illustrating an image forming unit illustrated in FIG. 2.

As shown in FIG. 3 illustrating the image forming unit 1, the toner supplying part 2 is equipped with a toner storing tank 17 which stores toner 18 as visualizing particles. Inside the toner storing tank 17, there are provided an agitating roller 19 for agitating the toner 18 thereby charging it, and a toner carrier 20, which is a visualizing particle carrier in a cylindrical shape, for carrying the toner 18 by electric force, magnetic force, or both of them. The toner carrier 20 carries the toner 18 on the circumferential surface thereof and transports while rotating. The toner storing tank 17 has an opening 17*a* through which the toner 18 is supplied. The opening 17*a* is disposed between the toner carrier 20 and the counter electrode 4.

The counter electrode 4 is provided vis-a-vis the toner carrier 20, and the image forming head 3 is provided between the counter electrode 4 and the toner carrier 20. The sheet 5 is transported between the image forming head 3 and the counter electrode 4 so that the sheet 5 is in contact with the surface of the counter electrode 4. Note that though the counter electrode 4 illustrated in FIG. 3 is in a plate-like shape, the counter electrode 4 may have any shape, such as the plate-like shape, or a cylindrical shape as shown in FIG. 2.

The image forming head 3 has a control electrode 22, which is disposed in an image forming region 21 provided between the opening 17*a* of the toner storing tank 17 and the counter electrode 4. The both edge parts of the control electrode 22 of the image forming head 3 curve in accordance with the outward form of the toner supplying part 2. A space between the control electrode 22 and the counter electrode 4 is a sheet transport route 29 as recording medium transport route. While the sheet 5 is transported through the sheet transport route 29, an toner image is formed thereon.

Figure 4:
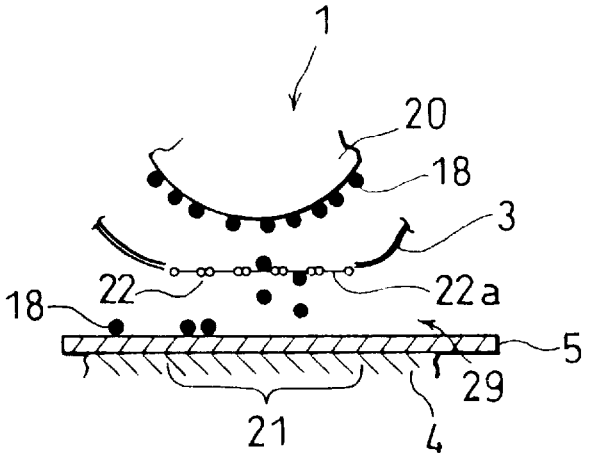
FIG. 4 is an enlarged view illustrating a portion around an image forming head illustrated in FIG. 3.

The control electrode 22, as shown in FIG. 4, has gates 22*a*, which are a plurality of holes for allowing the toner 18 to pass through the control electrode 22. The image forming unit 1 controls a voltage to be applied to the control electrode 22 and a voltage applied across the counter electrode 4 and the toner carrier 20, thereby controlling an electric field around the image forming head 3. With this arrangement, the toner 18 carried by the toner carrier 20 is caused to selectively fly in the direction to the counter electrode 4, so that a toner image is directly formed on the sheet 5 on the counter electrode 4. Note that the electric field around the image forming head 3 is exerted on at least the toner carrier 20, the control electrode 22, the sheet 5 on the counter electrode 4, and the counter electrode 4.

The following description will discuss in detail the principle of the above-described image formation. In general, when charged particles are positioned on an air (vacuum)-material boundary surface, attractive force is generated between the material boundary surface and the charged particles by electrostatic force, as well-known from a viewpoint of electromagnetism. Accordingly, the toner 18 is carried on the surface of the toner carrier 20 by electrostatic force. When an electric field greater than the electromagnetic attractive force between the toner 18 and the toner carrier 20 in this state is applied to the surface of the toner 20, the toner 18 comes off from the toner carrier 20, and is transferred in a specific direction with an acceleration by force of the electric field. Here, a strength of an electric field equivalent to the electromagnetic attractive force exerted between the toner 18 and the toner carrier 20 is called as a toner flight starting electric field Eth, and it took a value 1.0e6V/m in a certain experiment, for example. By generating the toner flight starting electric field Eth on the surface of the toner carrier 20, the toner 18 is caused to fly toward the counter electrode 4. Therefore, the flight of the toner 18 in accordance with an image signal can be obtained by generating the toner flight starting electric field Eth in accordance with the image signal on the surface of the toner carrier 20. The electric field is generated depending on a voltage applied to the control electrode 22, and a relation between potentials of the toner carrier 20 and the counter electrode 4.

Figure 5A:
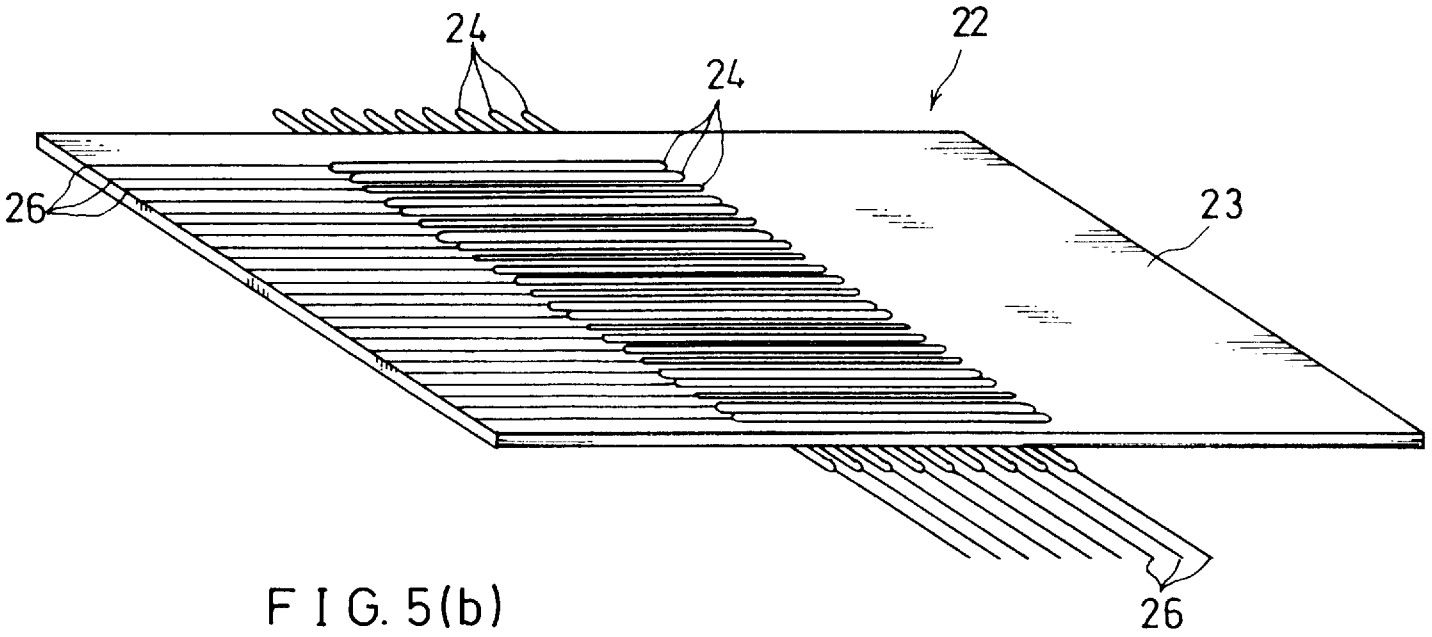
FIG. 5(*a*)is a perspective view illustrating an example of a control electrode illustrated in FIG. 4, and FIG. 5(*b*) is a cross-sectional view illustrating the control electrode illustrated in FIG. 5(*a*).
Figure 5B:
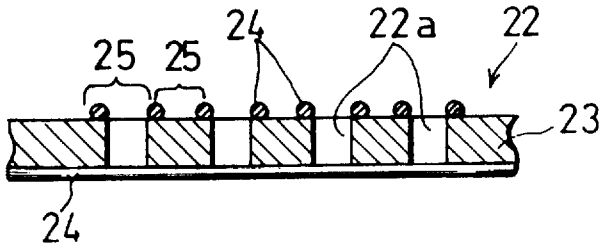
Figure 6:
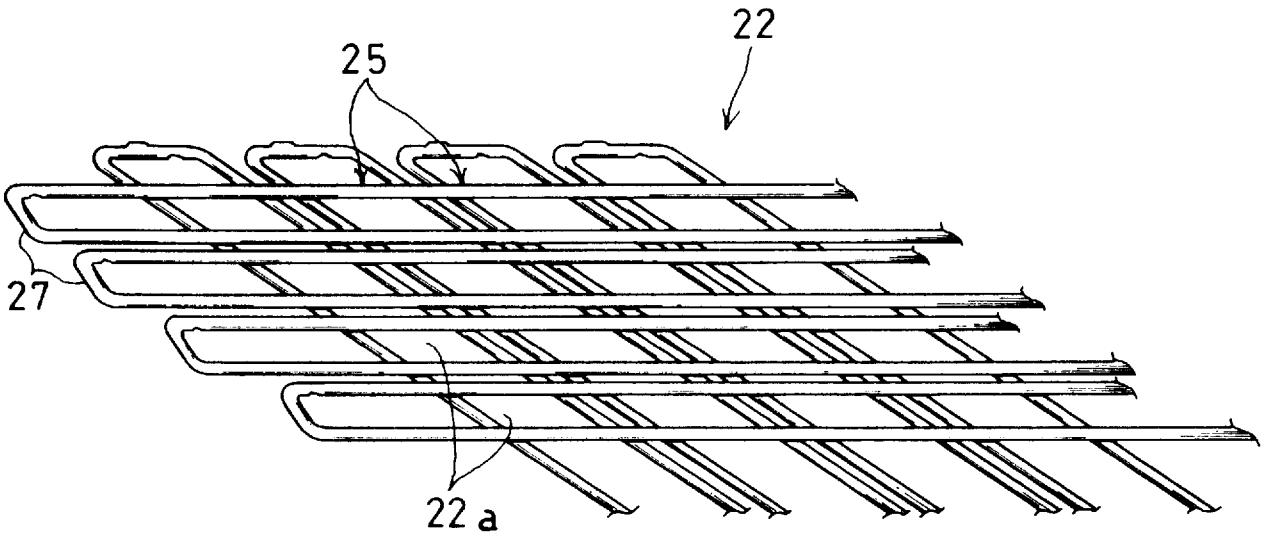
FIG. 6 is a perspective view illustrating a control electrode which has the same configuration as that illustrated in FIG. 5(*a*) but utilizes a different type of wires.
Figure 7A:
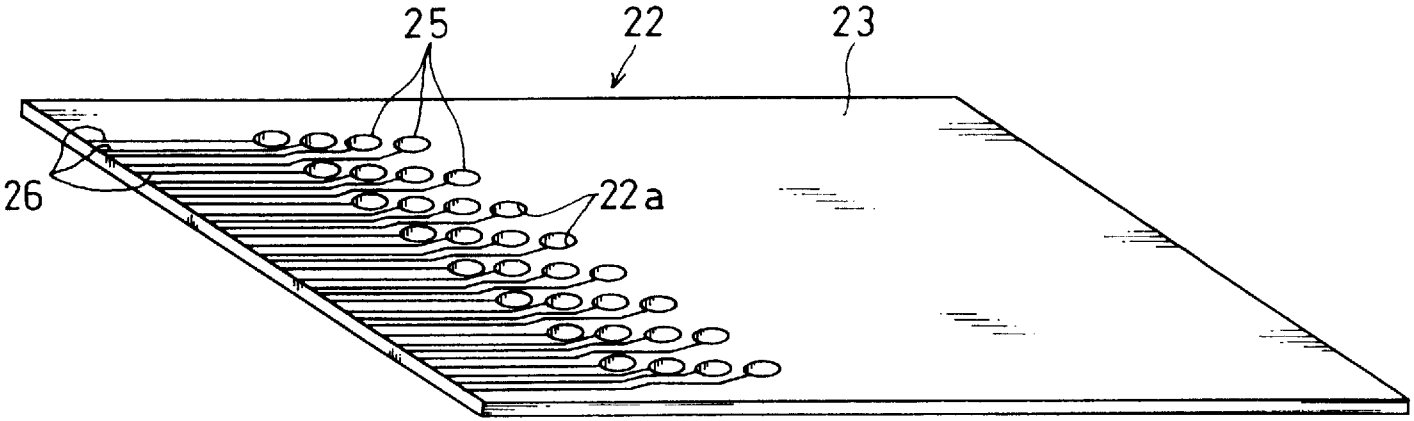
FIG. 7(*a*) is a perspective view illustrating another example of the control electrode illustrated in FIG. 5(*a*), and FIG. 7(*b*) is a cross-sectional view illustrating the control electrode illustrated in FIG. 7(*a*).
Figure 7B:
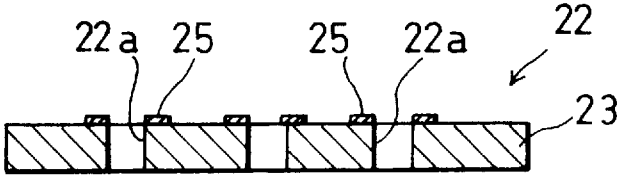
Figure 8:
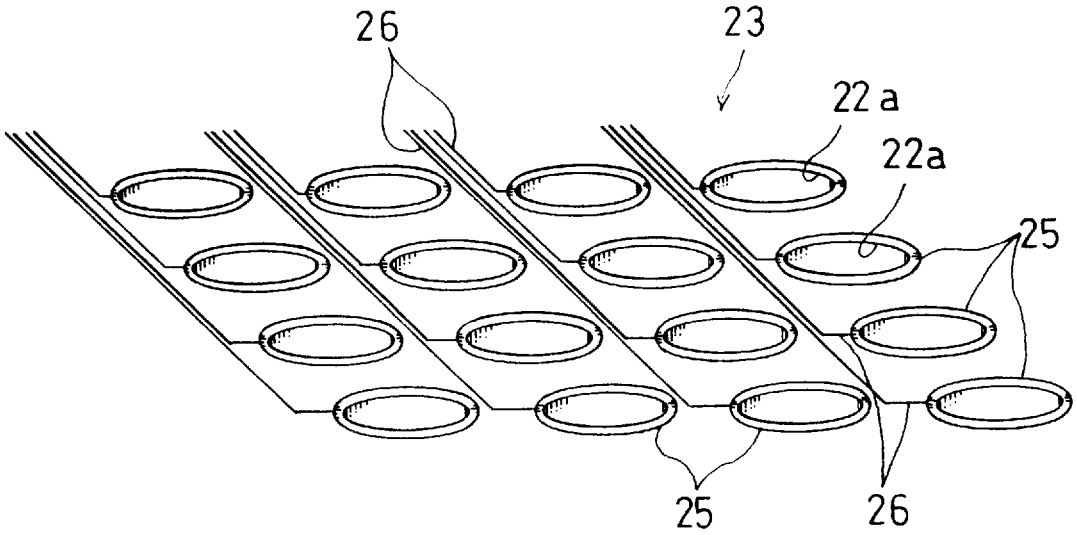
FIG. 8 is an enlarged perspective view illustrating control grids of the control electrode illustrated in FIG. 7(*a*).
Figure 9A:
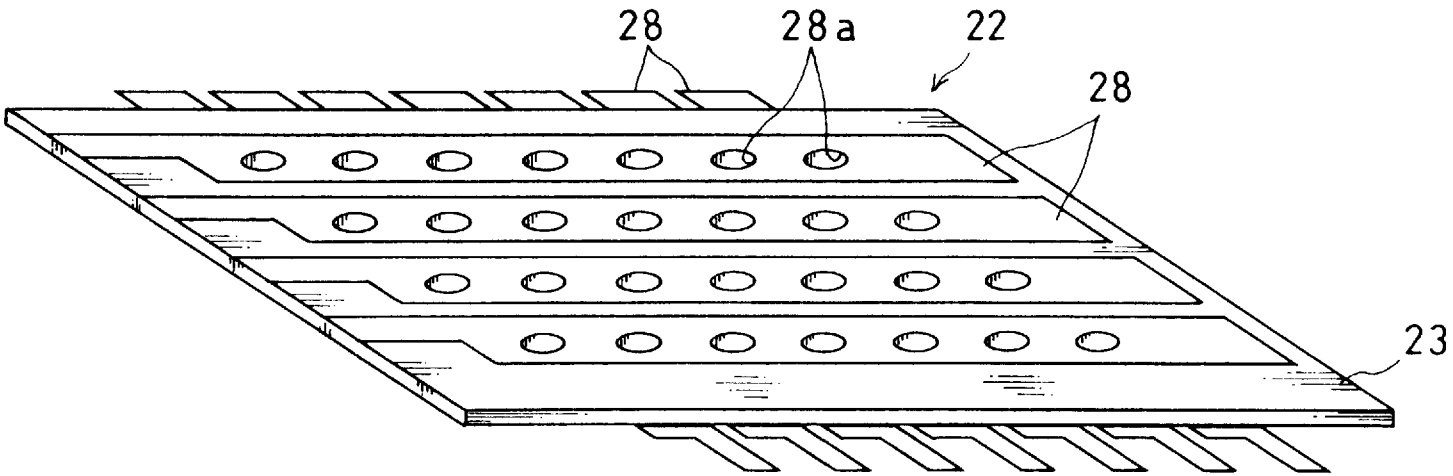
FIG. 9(*a*) is a perspective view illustrating another example of the control electrode illustrated in FIG. 5(*a*), and FIG. 9(*b*) is a cross-sectional view illustrating the control electrode illustrated in FIG. 9(*a*).
Figure 9B:
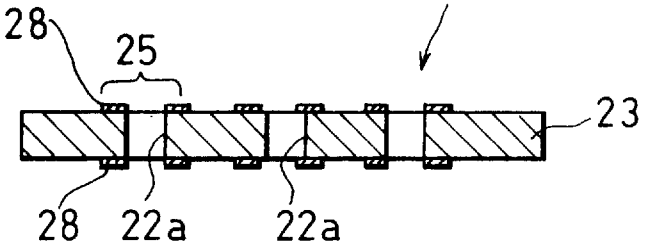
Figure 10:
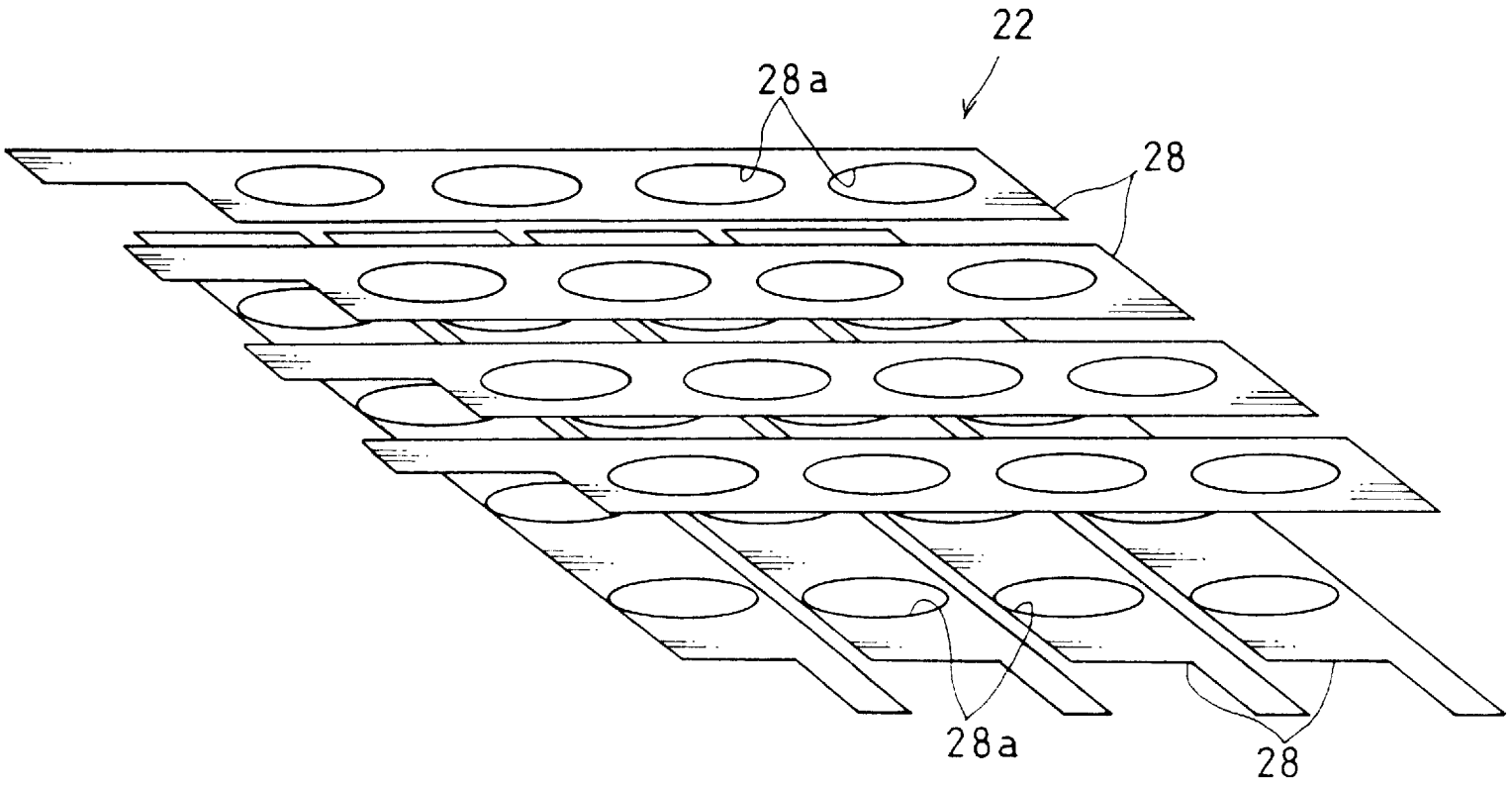
FIG. 10 is an enlarged perspective view illustrating plate electrodes of the control electrode illustrated in FIG. 9(*a*).

The control electrode 22 may have any of the arrangements shown in FIGS. 5(*a*) and 5(*b*), FIG. 6, FIGS. 7(*a*) and 7(*b*), FIG. 8, FIGS. 9(*a*) and 9(*b*), and FIG. 10. A control electrode 22 shown in FIGS. 5(*a*) and 5(*b*) is arranged so that a plurality of conductive wires 24 are provided in parallel on the both sides of an insulating substrate 23 as an insulating layer, the conductive wires 24 on one side and those on the other side being provided in directions perpendicular each other, thereby forming a net-shaped matrix. Note that FIG. 5(*b*) is a cross-sectional view of the control electrode 22 shown in FIG. 5(*a*) . The wires 24 on one side and those on the other side form, at intersections thereof, a plurality of control grids 25 which are electrode sections. Each wire 24 is connected to a leader line 26, through which control voltages are supplied from a control voltage applying part 33 shown in FIG. 11 to each wire 24, therefore, to each control grid 25. A toner passing hole is formed in the insulating substrate 23 in each portion surrounded by the control grids 25. The toner passing holes are equivalent to the above-mentioned gates 22*a*, thereby being hereinafter referred to as gates 22*a*.

A control electrode 22 shown in FIG. 6, like the electrode 22 described above, has two-layered wires 27 forming a net-shaped matrix. Between the layers of the wires 27, there is provided an insulating substrate 23 as described above (not shown). The wires 27 are folded at the edges of the insulating substrate 23, and gates 22*a* are formed in portions surrounded by the wires 27 of the two layers.

A control electrode 22 shown in FIGS. 7(*a*) and 7(*b*) is arranged so that a plurality of control grids 25 composed of conductive rings are regularly provided on one side of an insulating substrate 23. A control electrode 22 shown in FIG. 8 is arranged likewise. Note that FIG. 7(*b*) is a cross-sectional view of the electrode 22 shown in FIG. 7(*a*). Control grids are respectively connected to leader lines 26, through which a control voltage is supplied to each control grid 25. Gates 22*a* as described above are formed in the insulating substrate 23.

A control electrode shown in FIGS. 9(*a*) and 9(*b*) is arranged so that a plurality of conductive plate electrodes 28 are provided in parallel on the both sides of an insulating substrate 23. A control electrode 22 shown in FIG. 10 is arranged likewise. Note that the insulating substrate 23 is omitted in FIG. 10. The plate electrodes 28 on one side and those on the other side are provided in respective directions perpendicular each other. There are provided holes 28*a* in line on each plate electrode 28, so that holes 28*a* on the plate electrodes 28 on one side are provided vis-a-vis those on the other side, whereby a plurality of control grids 25 are formed. Note that gates 22*a* as mentioned above are formed in the insulating substrate 23.

Figure 11:
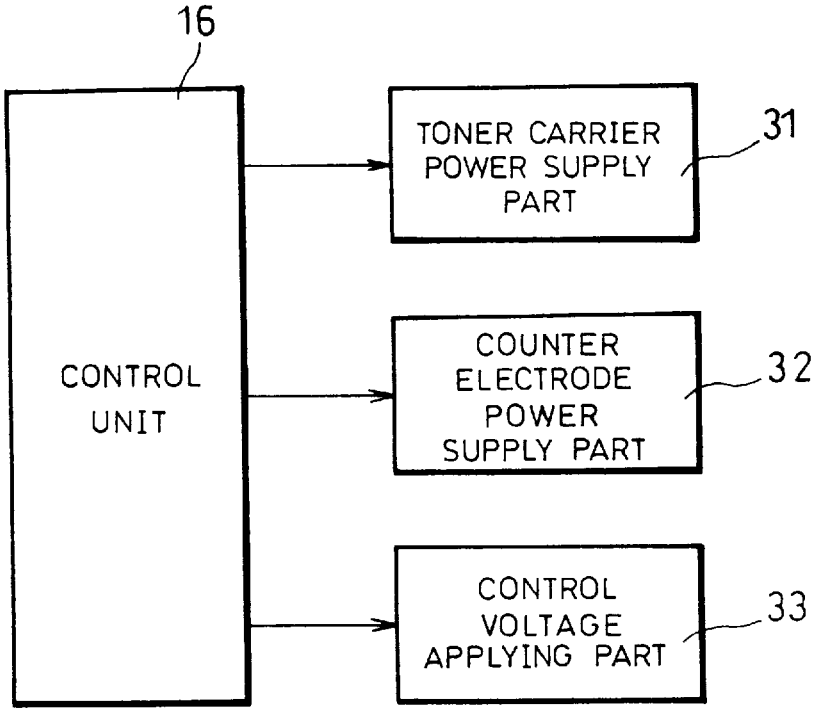
FIG. 11 is a block diagram illustrating voltage applying parts for applying voltages to the image forming unit of the image forming apparatus illustrated in FIG. 2, and a control unit for controlling the voltage applying parts.

An image forming apparatus in accordance with the present embodiment is provided with a toner carrier power supply part 31 and a counter electrode power supply part 32 which compose power supply means, and a control voltage applying part 33 which is control voltage supplying means, as shown in FIG. 11. Operations conducted by the toner carrier power supply part 31, the counter electrode power supply part 32, and the control voltage applying part 33 are controlled by the control unit 16. The toner carrier power supply part 31 supplies a bias potential $E_1$ (see FIG. 1(*a*)) and others to the toner carrier 20. The counter electrode power supply part 32 supplies an operating potential $E_2$ and others to the counter electrode 4. The control voltage applying part 33 supplies a flight suppressing voltage $E_3$, a toner flight voltage $E_4$ (see FIG. 1(*a*)), and others to the control electrode 22.

The following description will depict a motion sequence for image formation of the image forming apparatus in accordance with the above-mentioned arrangement of the present embodiment. In the image forming apparatus shown in FIG. 2, when a motor (not shown) of the image forming apparatus is actuated in response to an image formation start signal sent from a host computer (not shown), one of the sheets 5 in the sheet cassette 6 is sent out by the feed roller 7. When the sheet detecting member 8 is pushed up by the sheet 5 thus sent out, the feed sensor 9 detects a sheet feeding state, thereby issuing a detection signal. With the detection signal, the control unit 16 is informed of that the sheet 5 has been supplied in a normal state.

The transportation of the sheet 5 is once suspended when the sheet 5 reaches the register roller 10 not in motion. On the other hand, in response to the detection signal from the feed sensor 9, the control unit 16 starts issuing an image signal to be used in the image formation, in accordance with an image formation signal sent from the host computer. In the next stage, the control unit 16 converts the image signal to an electric signal to be sent to the control electrode 22 provided in the image forming head 3. After converting a predetermined quantity of image signals, the control unit 16 actuates a motor which drives the register roller 10, so that the register roller 10 transports the sheet 5 to the position of the control electrode 22, namely, the image forming region 21 shown in FIG. 12. Note that the quantity of image signals to be converted is predetermined depending on the arrangement of the image forming apparatus.

In the next stage, the control unit 16 sends the electric signal to the control electrode 22 through the control voltage applying part 33. On the other hand, voltages are applied to the toner carrier 20 and the counter electrode 4 by the toner carrier power supply part 31 and the counter electrode power supply part 32, respectively, thereby forming an electric field in a direction such that the toner 18 is caused to fly from the toner carrier 20 toward the counter electrode 4. As a result, the control electrode 22 in the image forming head 3 receives a control voltage in accordance with the electric signal supplied by the control voltage applying part 33, thereby controlling the electric field in the vicinity of the image forming head 3.

The control of the electric field by the control electrode 22 causes the toner 18 to selectively fly from the toner carrier 20 in the direction to the counter electrode 4, thereby resulting in adhesion of the toner 18 on the surface of the sheet 5 which is transported through the image forming unit 1. In this stage, the control unit 16 sends an electric signal to the image forming head 3 at a timing in synchronization with the transportation of the sheet 5. Therefore, a toner image in accordance with the image signal is obtained on the sheet 5.

The sheet 5 having the toner image thereon is transported to the fixing part 11, where the toner image is fixed on the sheet 5 by pressure, heat, or both of them. The sheet 5 having gone through the processing at the fixing part 11 is discharged to the discharge tray 15 by the discharge roller 12. In this stage, the sheet detecting member 13 is actuated by the sheet 5, thereby causing the discharge sensor 14 to detect that the sheet 5 is normally discharged. A detection signal issued by this is sent to the control unit 16, and the control unit 16, in response to the detection signal, judges that the image formation ends in a normal state.

The following description will discuss how the control unit 16 controls the voltage supply to the toner carrier 20, the counter electrode 4, and the control electrode 22.

Figure 1A:
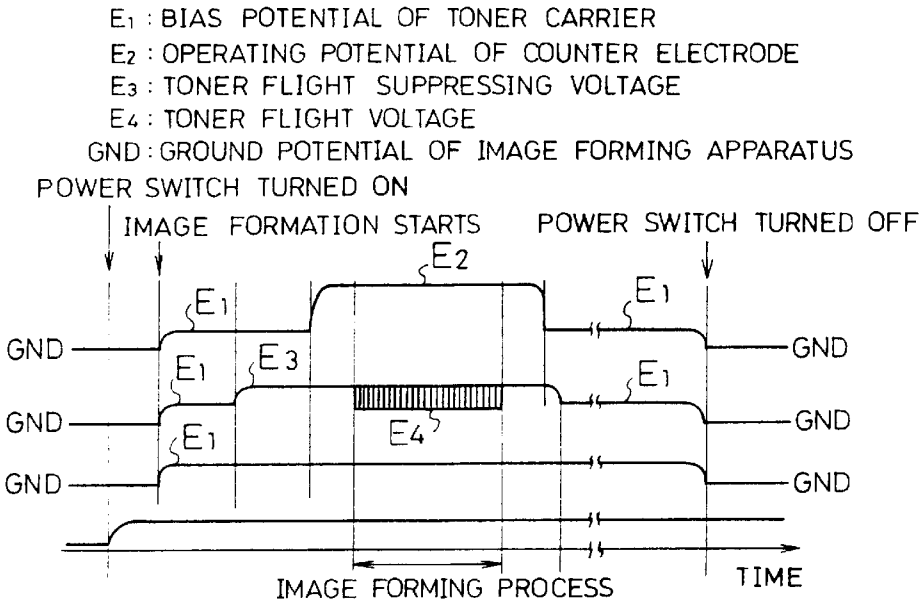
FIG. 1(*a*) is a timing chart of potentials of respective members of an image forming apparatus as one embodiment example, and FIG. 1(*b*) is another timing chart of potentials of respective members of the image forming apparatus.
Figure 1B:
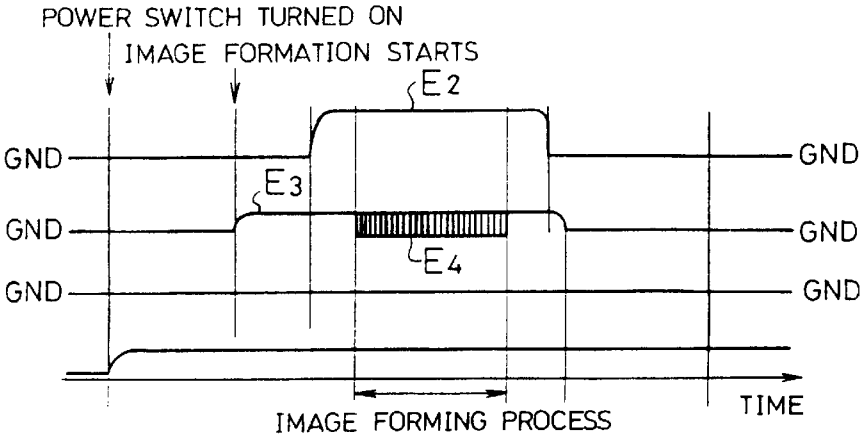

During the image formation, after a power switch is turned on, the potentials of the respective parts in the image forming unit 1 are controlled at timings as shown in FIG. 1(*a*). To be more specific, on turning on the power switch, the control unit 16 is actuated, thereby causing the toner carrier power supply part 31, the counter electrode power supply part 32, and the control voltage applying part 33 to stand by. In this state, the counter electrode 4, the control electrode 22, and the toner carrier 20 have the same potential as that of a ground terminal of the image forming apparatus (the potential is hereinafter referred to as ground potential (GND)). Therefore, the toner 18 carried by the toner carrier 20 is by no means caused to fly toward the counter electrode 4.

Thereafter, on turning on an image formation start switch (not shown), for example, potentials of the counter electrode 4, the control electrode 22, and the toner carrier 20 are set to the bias potential $E_1$ of the toner carrier 20. The toner 18 carried by the toner carrier 20 is not caused to fly toward the counter electrode 4, either in this state. Note that the bias potential $E_1$, which is slightly higher than the ground potential (GND) of the image forming apparatus, while lower than the operating potential $E_2$ of the counter electrode 4 (described later).

Subsequently the flight suppressing voltage $E_3$ for suppressing the flight of the toner from the toner carrier 20 to the counter electrode 4 is applied to the control electrode 22, which is followed by setting the potential of the counter electrode 4 to the operating potential $E_2$. Note that the operating potential $E_2$ causes an electric field to be generated between the toner carrier 20 an d the counter electrode 4 so that the electric field causes the toner 18 to fly from the toner carrier 20 toward the counter electrode 4. Thus, the potential of the counter electrode 4 is set to the operating potential $E_2$ after the flight suppressing voltage $E_3$ is applied to the control electrode 22 as described above. As a result, inappropriate flight of the toner 18 from the toner carrier 20 toward the counter electrode 4 is suppressed in the image forming apparatus of the present embodiment, even while the counter electrode 4 has the operating potential $E_2$.

Thereafter, image formation is carried out in the described state. During the image forming process, the voltage of the control electrode 22 is switched, in accordance with the image signal, between the flight suppressing voltage $E_3$, and a toner flight voltage $E_4$ for causing the toner 18 to fly from the toner carrier 20 toward the counter electrode 4. In the image forming process thus arranged, a toner image is formed on the sheet 5 being transported through the image forming region 21 over the counter electrode 4.

On the end of the image forming process, the potential of the counter electrode 4 is immediately switched from the operating potential $E_2$ to the bias potential $E_1$, so that inappropriate flight of the toner 18 from the toner carrier 20 toward the counter electrode 4 is suppressed. Thereafter the voltage of the control electrode 22 is switched from the flight suppressing voltage $E_3$ to the bias potential $E_1$. After the counter electrode 4, the control electrode 22, and the toner carrier 20 thus come to have the bias potential $E_1$, the potentials of the three are switched to the ground potential (GND) of the image forming apparatus.

As described above, after the respective potentials of the counter electrode 4, the control electrode 22, and the toner carrier 20 are switched from the ground potential (GND) to the bias potential $E_1$ of the toner carrier 20, the image forming process is carried out by using the bias potential $E_1$ as a reference potential during the image formation. With the image forming process thus arranged, images of higher quality are yielded compared with the case where, as shown in FIG. 1(*b*), the respective potentials of the above three members are not switched to the bias potential $E_1$ of the toner carrier 20. This has been confirmed by experiments. Note that it is possible to carry out the image forming process by setting the potentials as shown in FIG. 1(*b*) so as to prevent inappropriate flight of the toner 18, though it results in that the quality of obtained images may somewhat fall.

[Second Embodiment]

Figure 12:
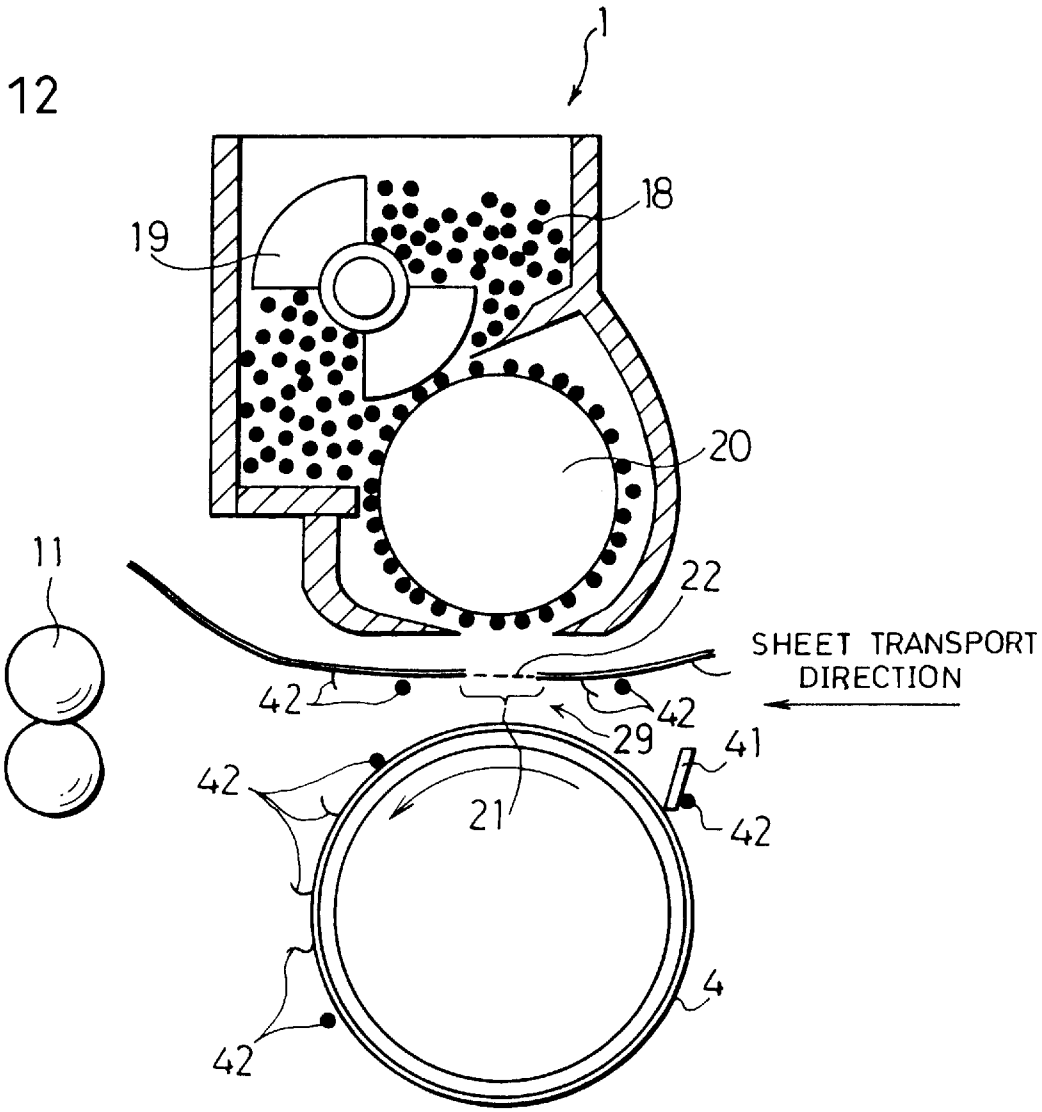
FIG. 12 is a schematic front view illustrating a structure of an image forming unit provided in an image forming apparatus in accordance with another embodiment of the present invention.
Figure 13:
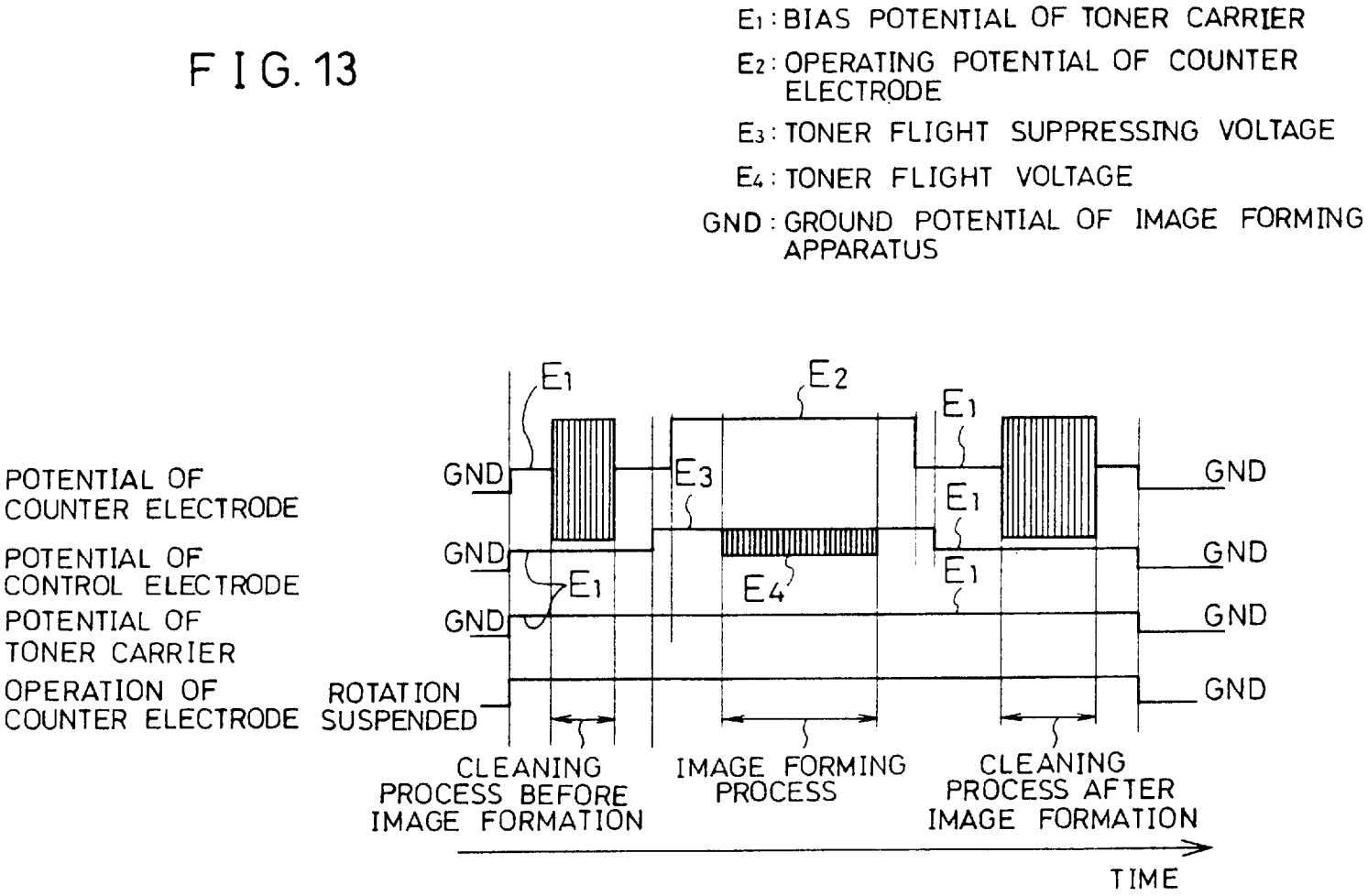
FIG. 13 is a timing chart of potentials of respective members of the image forming unit illustrated in FIG. 12, the potentials thereof during the image forming operation including the cleaning process.
Figure 14:
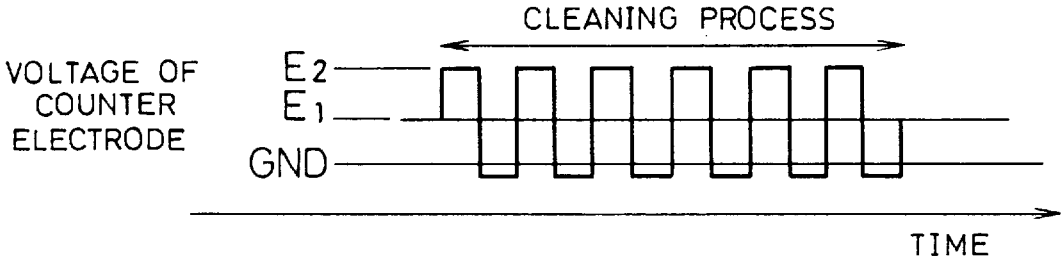
FIG. 14 is a view illustrating a waveform of a voltage applied to the counter electrode during the cleaning process illustrated in FIG. 13.

The following description will discuss another embodiment of the present invention, referring to FIGS. 12 through 14. The members having the same structure (function) as those in the above-mentioned embodiment will be designated by the same reference numerals and their description will be omitted.

An image forming apparatus in accordance with the present embodiment includes an image forming unit 1 shown in FIG. 12. The image forming unit 1 has a counter electrode 4 in a cylindrical shape, which is driven by a driving system (not shown) and rotates in a direction (indicated by an arrow in the figure) of transportation of a sheet 5 in synchronization with the transportation of the sheet 5 during image formation. The counter electrode 4 is provided with a cleaning blade 41, which is cleaning means for removing from the surface of the counter electrode 4 foreign material adhering thereto. The cleaning blade 41 is provided so that one edge thereof contacts the surface of the counter electrode 4.

FIG. 13 illustrates a cleaning process which is conducted in the image forming apparatus of the present embodiment before and after the image forming process. The cleaning process is controlled by the control unit 16 as cleaning process control means. The cleaning process is carried out by applying an alternating voltage shown in FIG. 14 to the counter electrode 4 in the state before and after the image forming process, the state wherein the counter electrode 4 has the bias potential $E_1$. The reason why the alternating voltage is employed is that the charged toner 18 does not have a fixed polarity, either positive or negative. The alternating voltage has a peak value set to the operating potential $E_2$ and a bottom value set to the ground potential (GND) of the image forming apparatus. Note that the voltage applied to the counter electrode 4 during the cleaning process is not restricted to the voltage shown in FIG. 14, but it may be an AC voltage having a sinusoidal waveform.

The image forming apparatus of the present embodiment thus provided with the cleaning blade 41 ensures that images of high quality are obtained, since affection of foreign material 42 adhering to the surface of the counter electrode 4 is eliminated, as described below.

During the image forming process, a voltage which causes the toner 18 to fly in the direction to the counter electrode 4 is applied to the counter electrode 4. The voltage causes not only the toner 18 carried by the toner carrier 20 to fly toward the counter electrode 4, but also causes foreign material 42 such as dust or paper powder to adhere to the counter electrode 4. Such foreign material 42 adhering to the counter electrode 4 interfere between the counter electrode 4 and the sheet 5 in the following image forming process, thereby causing a problem that the sheet 5 is not positioned properly in the image forming region 21. This hinders the toner 18 from properly adhering to constant positions, thereby causing deterioration of the image quality. However, the described problem can be solved by removal of the foreign material 42 by use of the cleaning blade 41.

The image forming apparatus of the present embodiment which carries out the above-described cleaning process ensures that images of high quality are obtained, by eliminating affection of the foreign material 42 on the image forming unit 1 as described below.

Before and after the image forming process, especially after the end of the image forming process, foreign material 42 such as dust and paper powder likely adheres to the surface of the control electrode 22 and a section, in the vicinity of the control electrode 22, of the surface of the image forming head 3, due to the application of the voltage to the control electrode 22 or other causes. The foreign material 42, usually charged, may change the potential distribution in the image forming region 21, thereby adversely affecting the flight of the toner 18. Note that it is indefinite whether the foreign material 42 has a positive polarity or a negative polarity.

Here, it is possible to cause the foreign material 42 adhering to the control electrode 22 to fly and adhere to the counter electrode 4 by applying the alternating voltage shown in FIG. 14 to the counter electrode 4 during the above-described cleaning process. The foreign material 42 on the counter electrode 4 is removed by the cleaning blade 41, as mentioned above. It is thus possible to prevent such foreign material 42 on the control electrode 22 from adversely affecting the flight of the toner 18, and therefore images of high quality are obtained.

Furthermore, in the above arrangement, performances of the cleaning process before and after the image forming process do not have uniform durations respectively, but a duration of the cleaning process after the image forming process is set longer than that before the image forming process. This is because the toner 18 having great affection likely adheres to the control electrode 22 after the image forming process and so does the foreign material 42. In contrast, only a small amount of the toner 18 and the foreign material 42 adhere to the control electrode 22 before the image forming process, since the cleaning process has already been executed after the previous performance of the image forming process, and since the adhering foreign material 42 is composed mainly of fine dust which has small affection. Therefore, with the described arrangement, in the case where the cleaning process is performed both before and after the image forming process, the period of time required for the performances of the cleaning process is reduced, while that the foreign material 42 is surely removed.

Note that according to the above arrangement the cleaning process is performed both before and after the image forming process, but it may be performed either before or after the image forming process.

[Third Embodiment]

The following description will discuss still another embodiment of the present invention, referring to FIGS. 3, 15 through 20. The members having the same structure (function) as those in the above-mentioned embodiment will be designated by the same reference numerals and their description will be omitted.

Figure 15:
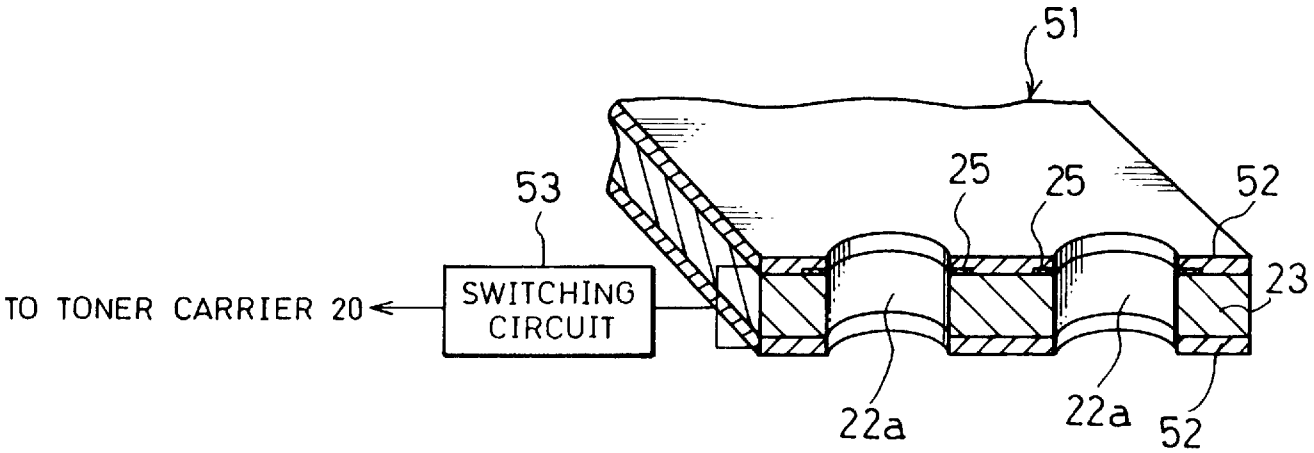
FIG. 15 is a perspective view illustrating a control electrode provided in an image forming apparatus in accordance with another embodiment of the present invention.
Figure 16:
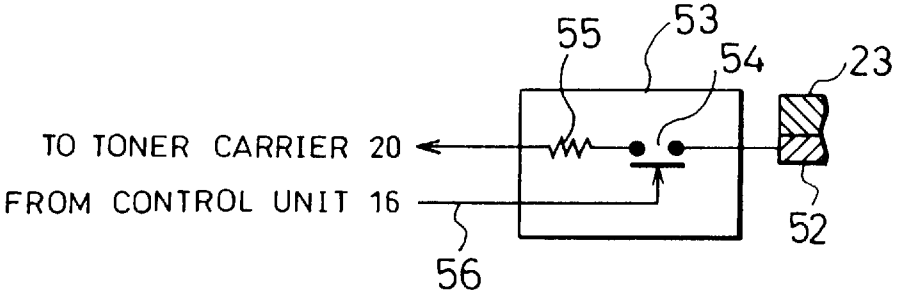
FIG. 16 is a circuit diagram of a switching circuit illustrated in FIG. 15.

An image forming apparatus in accordance with the present embodiment has an image forming unit 1, for example, as shown in FIG. 3, and an image forming head 3 provided therein is provided with a control electrode 51 shown in FIG. 15. The control electrode 51 is composed of a insulating substrate 23, ring-shaped control grids 25, and two resistive layers 52. The control grids 25 are regularly provided on one surface of the insulating substrate 23, and one resistive layer 52 is provided on the same surface so that the control grids 25 are buried under the resistive layer 52. The other resistive layer 52 is provided on the other side of the insulating substrate 23. Therefore, the control electrode 51 has the same configuration as the control electrode 22 shown in FIGS. 7(*a*) and 7(*b*), and FIG. 8, except that the control electrode 51 is provided with the resistive layers 52. The resistive layers 52 are realized by using insulating plastics such as polyimide whose resistivity is reduced by diffusing carbon thereon.

Note that the control electrode 51 may have the following configuration: the control grids 25 are provided on the resistive layer 52 covering one surface of the insulating substrate 23.

The two resistive layers 52 are connected to the toner carrier 20 through the intermediary of a switching circuit 53 which is a connecting circuit. The resistive layers 52 and the switching circuit 53 compose charge removing means. The switching circuit 53 is composed of a lead switch 54 and a resistor 55 connected in series. The lead switch 54 is connected to a control unit 16 by a control line 56, so that the switching on/off of the lead switch 54 is controlled by the control unit 16. Note that the resistor 55 may be omitted.

The resistive layers 52 are provided so that electric charges accumulated in the control electrode 51 are released through the switching circuit 53. Accordingly, the resistive layers 52 have a limited resistance. Here, the following two requisites arise: (1) resistance of the resistive layers 52 should be sufficiently smaller than a surface resistance of the insulating substrate 23; and (2) a time constant derived from the resistance of the resistive layers 52 and a capacitance between the control grids 25 should be sufficiently greater than a voltage control cycle of the grids 25.

Regarding the requisite (1), in the case where the resistance of the resistive layers 52 is greater than the surface resistance of the insulating substrate 23, the resistive layers 52 hinder the unnecessary electric charges accumulated on the surface of the control electrode 51 from coming off, thereby causing an adverse effect. Therefore, such an adverse effect is avoided by satisfying the requisite (1). Generally, an insulating substance has a surface resistance of $10^{14}\Omega$ through $10^{17}\Omega$. Therefore, the requisite (1) is satisfied by setting an upper limit of the resistance of the resistive layers 52 to around $10^{10}\Omega$ through $10^{12}\Omega$, which is 3 through 4 orders below the surface resistance of the insulating substance. On the other hand, the lower limit of the resistance of the resistive layers 52 depends on the capacitance between the control grids 25, the voltage control cycle of the control electrode 51, and the like.

The following description will examine the requisite (2). The control electrode 51 during the image formation has a voltage which varies due to control of the flight of the toner 18. Here, in the case where the electric charges quickly come off from the control electrode 51, namely, the resistance of the resistive layers 52 is small, it is likely that a predetermined voltage is not applied to the control grids 25 even though the application of the voltage has been actually attempted. Therefore, the unnecessary electric charges which are not caught by the resistive layers 52 should be released in a time span sufficiently greater than the control cycle of the control electrode 51. The quantity of unnecessary electric charges not caught by the resistive layers 52 are calculated with the resistance of the resistive layers 52 indicating liability to release the unnecessary electric charges, and the capacitance between the control grids 25 indicating liability to keep the electric charges. Generally, in the case where electric charges in a capacitor are not caught therein by a resistor and are released, the quantity of the electric charges remaining in the capacitor is given as EXP(−t/a), wherein t and a represent a time span of release and a time constant, respectively. Therefore, the period of time while the electric charges decrease becomes longer as the time constant is greater, while it becomes shorter as the time constant is smaller.

Here, from a viewpoint of the time constant, the following description will examine a lower limit of the resistance which the resistive layers 52 are required to have so that the unnecessary electric charges are not caught by the resistive layers 52 and released in a time span sufficiently longer than the control cycle of the control electrode 51, under conditions described below. A capacitance of control grids 25 in a control electrode for use in an apparatus with a resolution of 600 dpi is substantially not more than 1 pF. When the control electrode 51 has a voltage control cycle of 40 kHz, the resistance which the resistive layers 52 are required to have is $2.5\times10^{7}\Omega$. Therefore, the lower limit of the resistance of the resistive layers 52 is set to around $10^{10}\Omega$ through $10^{11}\Omega$, which is satisfactorily great, being 3 through 4 orders above the resistance derived from the capacitance of the control grids 25 and the voltage control cycle of the control electrode 51. Therefore, under the above conditions, the surface of the control electrode 51 is discharged in accordance with the function EXP(−t/a), by setting the resistance of the resistive layers 52 to around $10^{10}\Omega$ through $10^{11}\Omega$.

Figure 17:
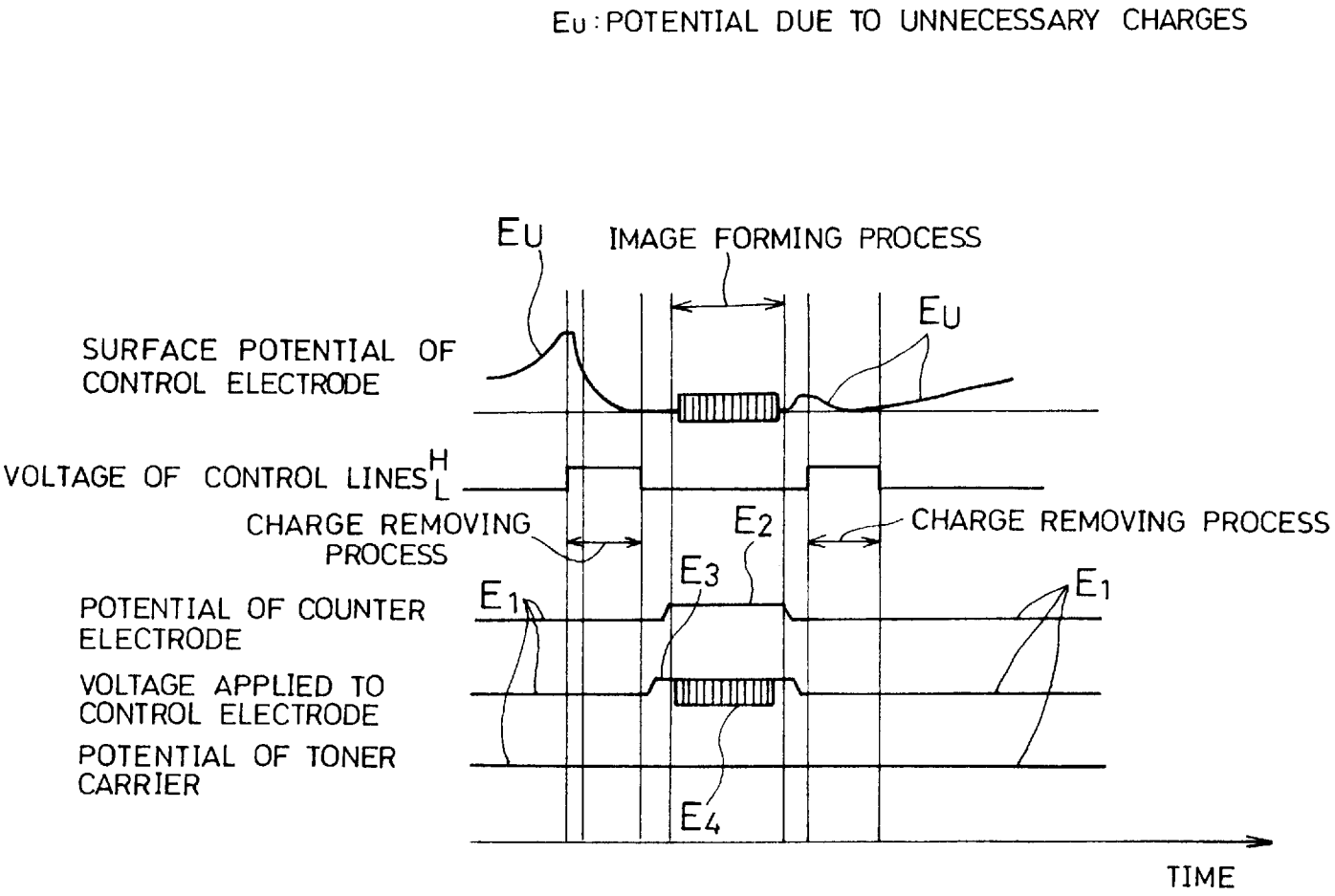
FIG. 17 is a timing chart of potentials of respective members of the image forming apparatus provided with the control electrode illustrated in FIG. 15, the potentials thereof during the image forming operation including the charge removing process for removing charges from the control electrode.

With the described arrangement, a process for removing electric charges from the control electrode 51 is carried out under the control of the control unit 16 before and after the image forming process, as shown in FIG. 17. Note that voltages for the image formation applied to the counter electrode 4, the control electrode 51, and the toner carrier 20 are controlled as described above with reference to FIG. 1.

When the charged toner and dust adhere to the control electrode 51, the surface potential of the control electrode 51 changes, as shown in FIG. 17. Therefore, the charge removing process is carried out before the image forming process, when the control electrode 51 has a potential set to the bias potential $E_1$ of the toner carrier 20. During the charge removing process, the voltage applied to the control line 56 is switched from a low level to a high level and is kept to the high level for a predetermined period of time, thereby turning on the lead switch 54 and causing the resistive layers 52 of the control electrode 51 to be connected to the toner carrier 20. Here, the electric charges adhering to the control electrode 51, which have spread over the resistive layers 52, are caused to move from the resistive layers 52 to the toner carrier 20. As a result, electric charges of the control electrode 51 are removed. Therefore, accurate control of the voltage applied to the control electrode 51 can be achieved, ensuring that images of high quality are obtained.

To be more specific, when electric charges adhere to a surface of a resistive substance or an insulating substance, generally the electric charges produce an electric field thereabout, due to influences of conductive substances, dielectric substances, other electric charges, or the like thereabout. Such an electric field, when generated in the vicinity of the control electrode 51, affects the control of the toner flight by the control electrode 51.

In the image forming unit 1, it is impossible to control the electric field produced by the electric charges adhering to the insulating substance of the control electrode 51, even though the voltage applied to the control electrode 51 and the positions of the image forming head 3 and other members are controllable and adjustable. Generally, ions adhering to a surface of a conductive substance are neutralized with supply of electric charges from the conductive substance. In contrast, ions adhering to a surface of an insulating substance are hardly removed by, for example, ionizing the surface of the insulating substance and applying a cleaning electric field.

Therefore, it is necessary to prevent charged substances from adhering to the control electrode 51 having the insulating substance. However, the air contains electric charges in a certain rate due to cosmic rays (charged particles coming outside the earth). The electric charges exist in the air as ionized molecules of air components and such ionized molecules adhering to dust or the like. Therefore, application of a voltage to the control electrode 51 produces an electric field, and the electric field affects the electric charges, causing them to adhere to every part of the control electrode 51. In this case, the control electrode 51 has a potential which is a sum of the predetermined voltage applied thereto by the control voltage applying part 33 and a potential of the electric charges adhering to the surface of the control electrode 51, thereby having a potential different from the predetermined voltage. As a result, potentials in the vicinity of the image forming head 3, especially the potential on the surface of the control electrode 51 go out of control. However, as described above, control of the surface potential of the control electrode 51 should be made possible by removing the unnecessary charges from the control electrode 51. By doing so, the flight of the toner 18 is accurately controlled by the control electrode 51, ensuring that images of high quality are obtained.

Figure 18:
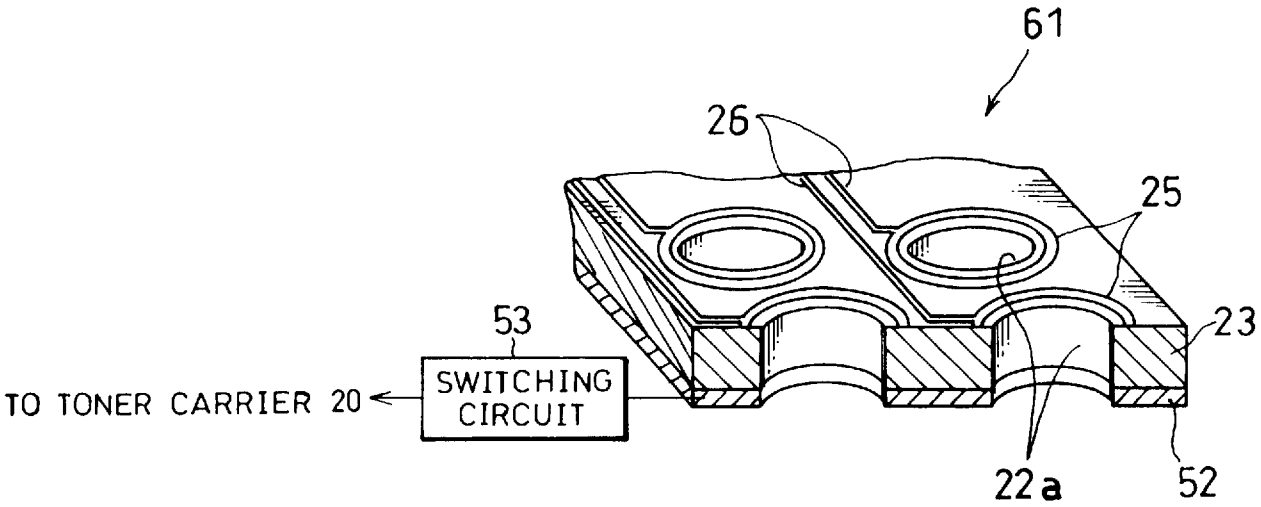
FIG. 18 is a perspective view illustrating another example of the control electrode illustrated in FIG. 15.

Note that the control electrode 51 may have the same configuration as that of a control electrode 61 shown in FIG. 18, which is arranged so that only one resistive layer 52 is applied on a surface of the insulating substrate 23 where the control grids 25 are not provided, though the control electrode 51 shown in FIG. 15 has the two resistive layers 52 provided on both sides of an insulating substrate 23. In the case of the control electrode 61, it is not necessary to satisfy the requisite (2) since the resistive layer 52 is not in contact with the control grids 25.

Though the resistive layers 52 are connected to the toner carrier 20 in the described arrangements, the resistive layers 52 may be connected to, for example, the ground terminal of the image forming apparatus. In other words, the resistive layer 52 may be connected to any part, provided that unnecessary electric charges of the control electrode 51 or 61 are released.

Figure 19:
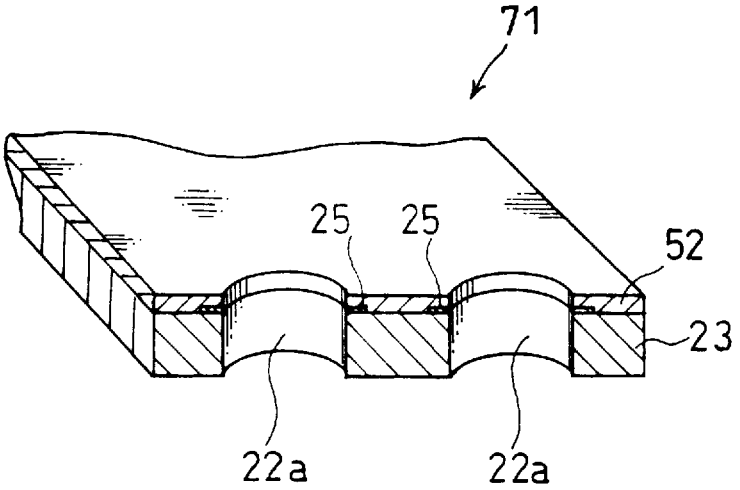
FIG. 19 is a perspective view illustrating still another example of the control electrode illustrated in FIG. 15.

Furthermore, a control electrode 71 shown in FIG. 19 may substitute for the control electrode 51. The control electrode 71 has the same configuration as that of the control electrode 51 shown in FIG. 15 except that the surface of the insulating substrate 23 where the control grids 25 are not provided does not have the resistive layer 52. In short, the control electrode 71 is arranged so that the resistive layer 52 is in contact with the control grids 25. Therefore, the unnecessary electric charges adhering to the insulating substrate 23 reach the control grids 25 through the resistive layer 52, and are released through the circuits connected to the control grids 25, for example, the control voltage applying part 33, thereby resulting in that the unnecessary electric charges are removed from the control electrode 71. In this case, the control grids 25 are connected to, for example, a ground terminal of the image forming apparatus through the control voltage applying part 33 in the stand-by state prior to the image forming operation, as shown in FIG. 1(*a*). This simplifies the arrangement, since it is not necessary to connect the resistive layer 52 to the toner carrier 20 through the switching circuit 53.

Note that the control electrode 71 may be arranged so that the control grids 25 are formed on the resistive layer 52 provided on the insulating substrate 23.

Figure 20:
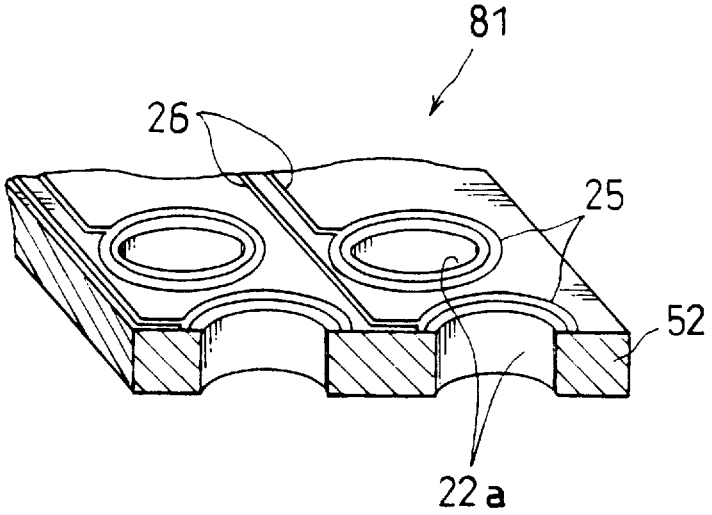
FIG. 20 is a perspective view illustrating still another example of the control electrode illustrated in FIG. 15.

Furthermore, a control electrode 81 shown in FIG. 20 may substitute for the control electrode 51. The control electrode 81 is arranged so that the control grids 25 are formed over the resistor layer 52 as a substrate, instead of the insulating substrate 23.

The control electrode 81 without the insulating substrate 23 thus has a simpler configuration. In addition, as is the case with the control electrode 71 wherein the resistive layer 52 is in contact with the control grids 25, the resistive layer 52 is not necessarily connected to, for example, the toner carrier 20 through the switching circuit 53 in the control electrode 81, thereby simplifying the arrangement of the control electrode 81.

Moreover, the control electrodes 51, 61, 71, and 81 may have the control grids in accordance with any of the arrangements shown in FIGS. 5(*a*) and 5(*b*), and FIG. 6 wherein the wires 24 and 27 are employed respectively, and the arrangements shown in FIGS. 9(*a*) and 9(*b*), and FIG. 10 wherein the plate electrodes 28 are employed.

[Fourth Embodiment]

Figure 21:
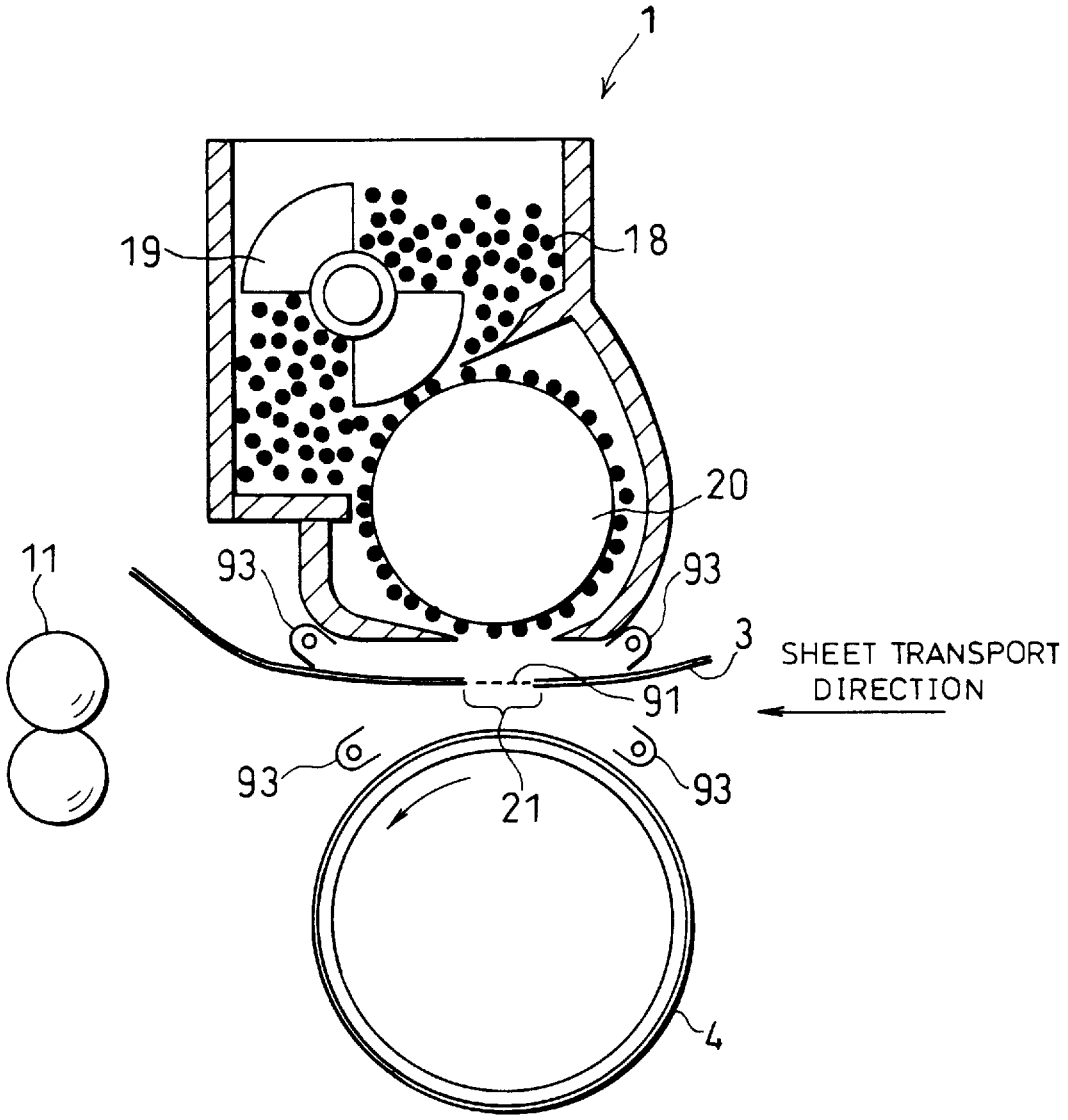
FIG. 21 is a schematic front view illustrating a structure of an image forming unit provided in an image forming apparatus in accordance with another embodiment of the present invention.
Figure 22:
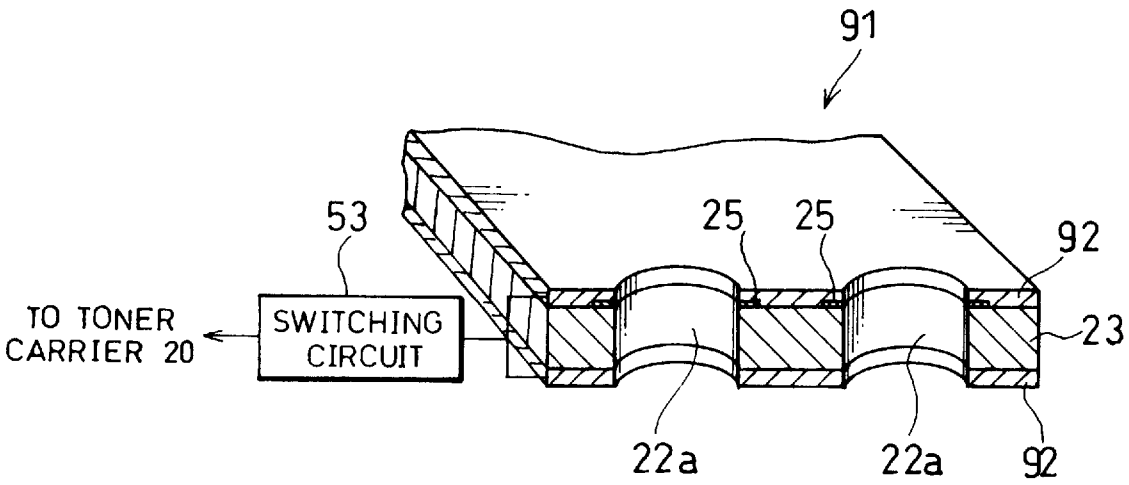
FIG. 22 is a perspective view illustrating the control electrode illustrated in FIG. 21.
Figure 23:
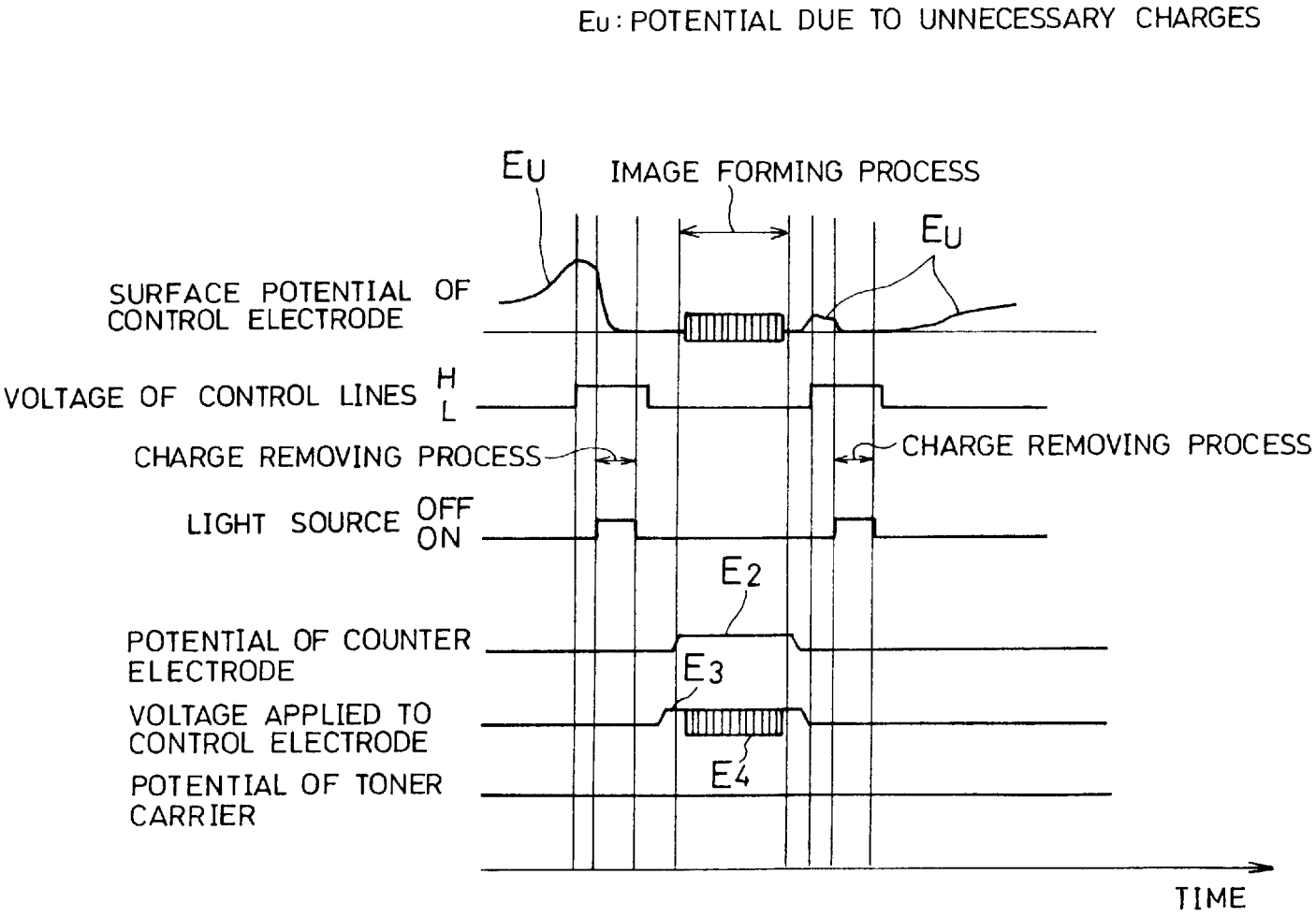
FIG. 23 is a timing chart of potentials of respective members of the image forming unit illustrated in FIG. 21, the potentials thereof during the image forming operation including the charge removing process for removing charges from the control electrode.

The following description will discuss still another embodiment of the present invention, with reference to FIGS. 21 through 23. The members having the same structure (function) as those in the above-mentioned embodiment will be designated by the same reference numerals and their description will be omitted.

An image forming apparatus of the present embodiment is provided with, for example, an image forming unit 1 shown in FIG. 21, which has an image forming head 3 provided with a control electrode 91 shown in FIG. 22. The control electrode 91 is composed of an insulating substrate 23, ring-shaped control grids 25, and two photoconductive layers 92. The control grids 25 are regularly provided on one surface of the insulating substrate 23, and one of the photoconductive layers 92 is formed so that the control grids 25 are buried under the photoconductive layer 92. The other photoconductive layer 92 is formed on the other surface of the insulating substrate 23. In short, the control electrode 91 has the same configuration as that of the control electrode 22 shown in FIGS. 7(*a*) and 7(*b*), and FIG. 8, except that the control electrode 91 is provided with the photoconductive layers 92. The photoconductive layers 92, for example, have insularity in an ordinary state, while the same have a smaller resistance when light is projected thereon. The photoconductive layers 92 are respectively connected to a toner carrier 20 through a switching circuit 53.

The photoconductive layers 92 are realized by (1) a substance whose resistance changes due to light, for example, an optical semiconductor such as a photoconductive conductor (OPC) or CdS, or a compound of them, or (2) a substance which is produced by diffusion of any of the above substances which have a resistance varying due to light.

Note that the control electrode 91 may be arranged so that the control grids 25 are provided over one of the photoconductive layers 92 provided on the surfaces of the insulating substrate 23.

As shown in FIG. 21, there are provided, for example, four light sources 93 in the vicinity of the control electrode 91, so that light is projected on the photoconductive layers 92. The turning on/of f of the light sources 93 is controlled by the control unit 16. Note that the number and positions of the light sources 93 are not specified, provided that the photoconductive layers 92 are irradiated by the same.

With the described arrangement, a charge removing process for the control electrode 91 is carried out under the control of the control unit 16 before and after the image forming process, as shown in FIG. 23. Note that voltages shown in the figure which are applied for image formation to the counter electrode 4, the control electrode 91, and the toner carrier 20 are controlled as described above with reference to FIG. 1.

The charge removing process is carried out with respect to the control electrode 91 when the potential of the control electrode 91 is set to the bias potential $E_1$ of the toner carrier 20. In the charge removing process, the light sources 93 are turned on so as to irradiate the photoconductive layers 92 during a period while a voltage applied to the control line 56 is set to the high level and thereby causes the photoconductive layers 92 to be connected to the toner carrier 20. The projection of the light causes the photoconductive layers 92 to shift so as to have a limited dark resistance, whereby the electric charges adhering to the control electrode 91 are allowed to move from the photoconductive layers 92 to the toner carrier 20, thus resulting in that unnecessary charges of the control electrode 91 are removed. Accordingly, the voltage applied to the control electrode 91 is accurately controlled, thereby ensuring that images of high quality are obtained.

The described arrangement also ensures that the control electrode 91 is easily produced. The resistive layers 52 described before are required to have a resistance which is low enough to let unnecessary electric charges to come off from the control electrode while which is high enough, during the image formation, to surely apply control voltages. On the other hand, an appropriate range of resistance of the resistive layers 52 varies depending on the image forming speed and the resolution. Therefore, it is required to select a different substance to be used as the resistive layers 52 whenever the resistive layers 52 are adopted to a different image forming apparatus which has a different image forming speed and a different resolution. In contrast, with the use of the photoconductive layers 92 which have a resistance falling in response to the irradiation of light, the control electrode 91 is easily produced.

Note that the control electrode 91 may also have any of the following configurations: the same configuration as that of the control electrode 61 shown in FIG. 18 except that the photoconductive layer 92 substitutes for the resistive layer 52; the same configuration as that of the control electrode 71 shown in FIG. 19 except that the photoconductive layer 92 substitutes for the resistive layer 52; the same configuration as that of the control electrode 81 shown in FIG. 20 except that the photoconductive layer 92 substitutes for the resistive layer 52.

The charge removing process is may carried out either after or before the image forming process, though the above description depicts that it is carried out both before and after the image forming process.

Furthermore, the resistive layers 52 or the photoconductive layers 92 may be connected to, for example, the ground terminal of the image forming apparatus, though they are connected to the toner carrier 20 in the foregoing arrangements. In short, the resistive layers 52 or the photoconductive layers 92 may be connected to any member, provided that unnecessary charges are released from the control electrode 51, 61, or 91.

[Fifth Embodiment]

Figure 24:
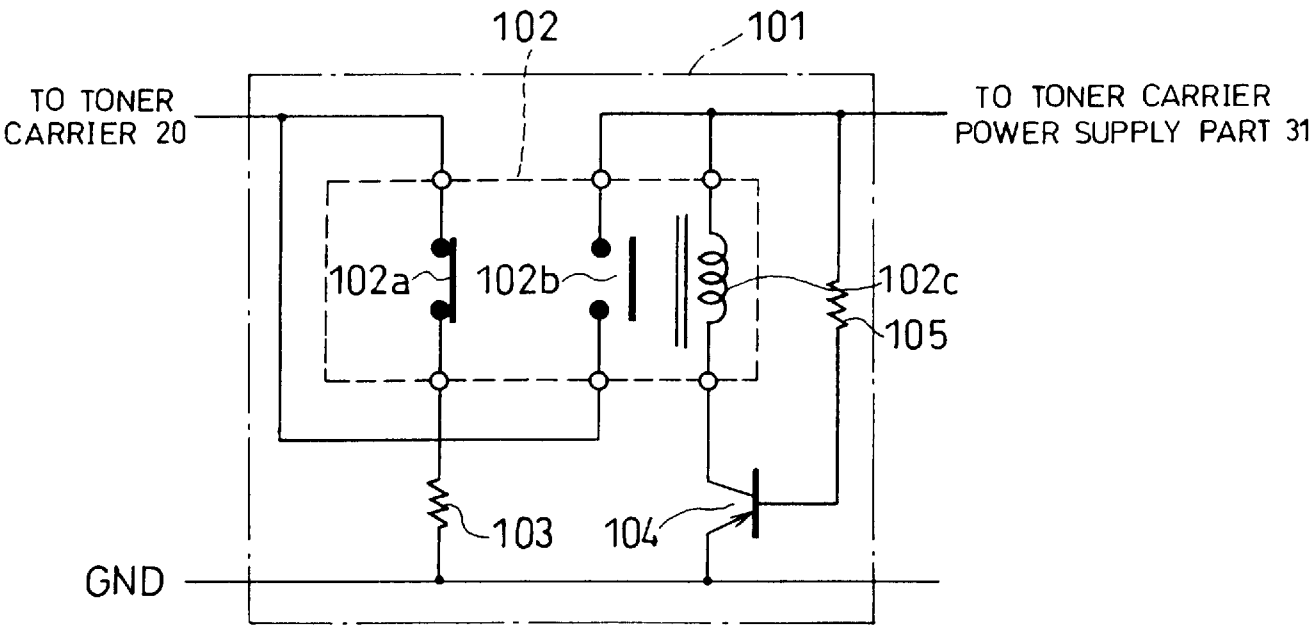
FIG. 24 is a circuit diagram illustrating a charge removing circuit for a toner carrier provided in an image forming apparatus in accordance with still another embodiment of the present invention.

The following description will discuss still another embodiment of the present invention, with reference to FIGS. 3 and 24. The members having the same structure (function) as those in the above-mentioned embodiment will be designated by the same reference numerals and their description will be omitted.

An image forming apparatus of the present embodiment has an image forming unit 1, wherein a toner carrier 20 is connected to a toner carrier power supply part 31 and a ground terminal of the image forming apparatus through a switching circuit 101 as a connecting circuit shown in FIG. 24. Note that the switching circuit 101 is applicable in the case where the bias potential $E_1$ to be supplied to the toner carrier 20 has a negative polarity. The switching circuit 101 is provided with a relay 102 as switching means, which is composed of a normally closed contact 102*a*, a normally opened contact 102*b*, and a electromagnetic coil 102*c*.

One terminal of the contact 102*a* is connected to the toner carrier 20 while the other terminal thereof is connected to the ground terminal through a resistor 103. One terminal of the contact 102*b* is connected to the toner carrier power supply part 31, while the other terminal thereof is connected to the toner carrier 20. One terminal of the electromagnetic coil 102*c* is connected to the toner carrier power supply part 31 while the other terminal thereof is connected to a corrector of a transistor 104 of a PNP type. An emitter of the transistor 104 is connected to the ground terminal while a base thereof is connected to the toner carrier power supply part 31 through a resistor 105.

With the foregoing arrangement, when the power switch of the image forming apparatus is turned on thereby actuating the toner carrier power supply part 31, the transistor 104 is turned on and the contact 102*a* is opened, while the contact 102*b* is closed. As a result, the toner carrier 20 is caused to have the bias potential $E_1$ as shown in FIG. 1.

Here, it generally takes longer for a power source to achieve a voltage of a predetermined level, as the power source has a greater capacity and as the predetermined level is higher. Therefore, it takes a certain period of time for a power source provided in the toner carrier power supply part 31 to achieve a predetermined voltage. For this reason, the switching circuit 101 connects the toner carrier 20 and the ground terminal of the image forming apparatus through the intermediary of the resistor 103 with a limited resistance, until the output voltage of the toner carrier power supply part 31 reaches a predetermined level. When the output voltage of the toner carrier power supply part 31 reaches a predetermined level, the transistor 104 is turned on, thereby applying current between the corrector and the emitter. When the current is applied to the electromagnetic coil 102*c*, the contact 102*a* is opened while the contact 102*b* is closed. As a result, the circuit is switched so as to disconnect the toner carrier 20 to the ground terminal through the resistor 103, while so as to connect the toner carrier 20 to the toner carrier power supply part 31, thereby causing the toner carrier 20 to have the bias potential $E_1$.

On the other hand, when the power switch is turned off and the operation of the toner carrier power supply part 31 is suspended, the power source voltage of the toner carrier power supply part 31 has a level lower than the predetermined voltage level. This causes, in the switching circuit 101, the transistor 104 to be turned off, thereby suspending the current supply between the corrector and the emitter. As a result, in the relay 102, the contact 102*a* is closed while the contact 102*b* is opened. Thus, the toner carrier 20 is connected to the ground terminal of the image forming apparatus through the resistor 103.

Since the toner carrier 20 is connected to the ground terminal of the image forming apparatus when the power switch is in the OFF state, the described arrangement of the image forming apparatus of the present embodiment ensures that the toner carrier 20 has a stable potential when the power switch is in the OFF state. As a result, the flight and scattering of the toner 18 from the toner carrier 20 when the power switch is in the OFF state is suppressed. Therefore, it is possible to prevent the toner 18 from adhering to the counter electrode 4 and the control electrode 22 thereby dirtying sheets, and to prevent inadequate control of the flight of toner.

To be more specific on this respect, an output impedance of a power supply circuit in an operational state is generally set to a fixed level, while that in a non-operational state is not set. Especially in a low-priced power source, the output impedance in a non-operational state is often set to the infinite. In such a case, a potential from the power source to the members to which voltages are to be applied is very unstable in a non-operational state. This tends to cause the toner carrier 20, which is one of such voltage applied members, to have a potential which is caused due to friction or the like, thereby resulting in scattering of the visualizing particles or adhesion of dust. In contrast, with the foregoing arrangement, the toner carrier 20 is allowed to have a stable potential, as mentioned above, when the power source is in the OFF state, namely, when a voltage is not applied.

Note that a lead switch may be employed instead of the relay 102, in the switching circuit 101.

[Sixth Embodiment]

Figure 25:
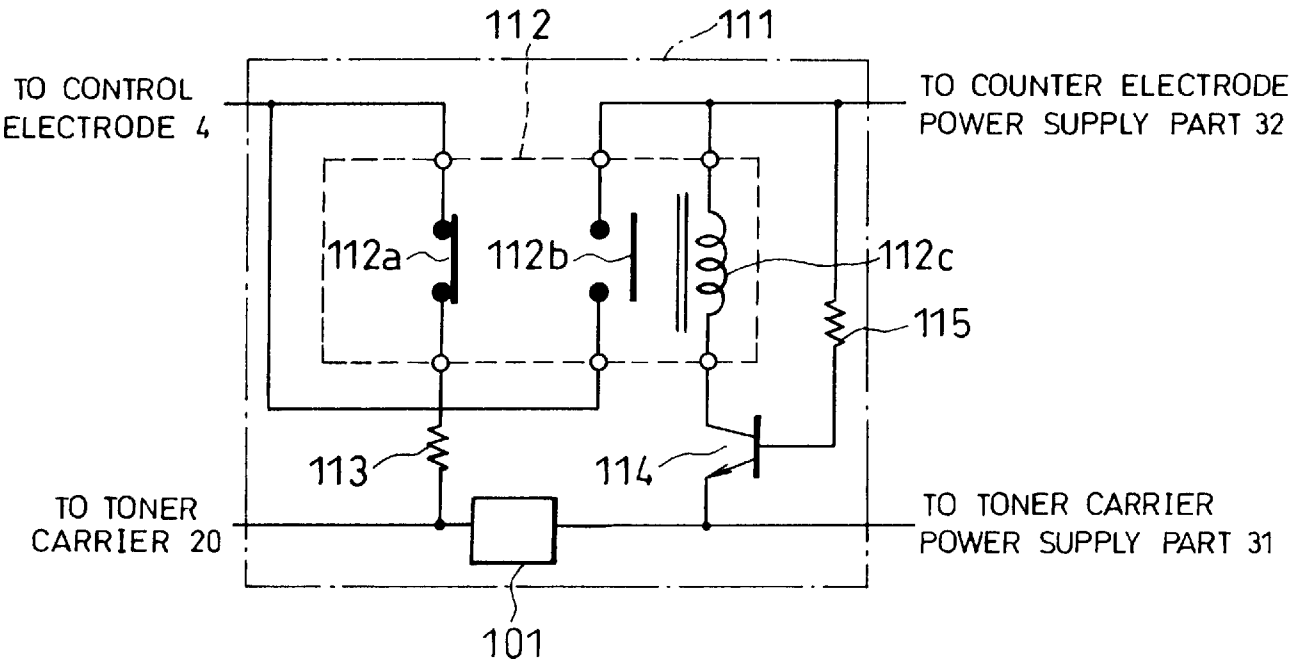
FIG. 25 is a circuit diagram illustrating a charge removing circuit for a counter electrode provided in an image forming apparatus in accordance with still another embodiment of the present invention.

The following description will discuss still another embodiment of the present invention, with reference to FIGS. 3 and 25. The members having the same structure (function) as those in the above-mentioned embodiment will be designated by the same reference numerals and their description will be omitted.

An image forming apparatus of the present embodiment has, for example, an image forming unit 1 shown in FIG. 3, and the image forming unit 1 includes a switching circuit 111 shown in FIG. 25 as a connecting circuit. The switching circuit 111 is composed of a relay 112 which is switching means having the same configuration as that of the relay 102, resistors 113 and 115, a transistor 114 of an NPN type, and the above-described switching circuit 101. Note that the switching circuit 111 is applicable in the case where the toner 18 is negatively charged.

The relay 112 includes a normally closed contact 112*a*, a normally opened contact 112*b*, and an electromagnetic coil 112*c*. One terminal of the contact 112*a* is connected to a counter electrode 4 while the other terminal thereof is connected to a toner carrier 20 through the resistor 113. One terminal of the contact 112*b* is connected to a counter electrode power supply part 32 while the other terminal is connected to the counter electrode 4. One terminal of the electromagnetic coil 112*c* is connected to the counter electrode power supply part 32 while the other terminal thereof is connected to a corrector of the transistor 114. The transistor 114 has an emitter connected to the toner carrier power supply part 31 and a base connected to the counter electrode power supply part 32 through the resistor 115. The toner carrier 20 is connected to the toner carrier power supply part 31 through the switching circuit 101, as shown in FIG. 24.

With the described arrangement, when a voltage for causing the counter electrode 4 to have the operating potential $E_2$ shown in FIG. 1 is outputted from the counter electrode power supply part 32, the transistor 114 is turned on, wherein the contact 112*a* is opened while the contact 112*b* is closed, thereby causing the counter electrode 4 to have the operating potential $E_2$.

In this case, as described before, generally it takes longer for a power source to achieve a voltage of a predetermined level, as the power source has a greater capacity and as the predetermined level is higher. Therefore, the switching circuit 111 connects the counter electrode 4 to the toner carrier 20 through the intermediary of the resistor 113 having a limited resistance, until the voltage outputted by the counter electrode power supply part 32 reaches the predetermined level. Therefore, in this state, the counter electrode 4 has the bias potential $E_1$ of the toner carrier 20.

In the next stage, when the voltage outputted by the counter electrode power supply part 32 reaches the predetermined level, the transistor 114 is turned on, thereby applying current between the corrector and the emitter. When the current is applied to the electromagnetic coil 112*c*, the contact 112*a* is opened while the contact 112*b* is closed. As a result, the circuit is switched so as to disconnect the counter electrode 4 to the toner carrier 20, while so as to connect the counter electrode 4 to the counter electrode power supply part 32, thereby causing the counter electrode 4 to have the operating potential $E_2$.

On the other hand, when the output of the counter electrode power supply part 32 is suspended on the end of the image forming process, the output voltage of the counter electrode power supply part 32 becomes below the predetermined level. In such a case, it generally takes longer for the output of the power source to fall to nil, as the power source has a greater capacity and as the predetermined level is higher. With fall of the output of the counter electrode power supply part 32, the transistor 114 is turned off in the switching circuit 111, thereby suspending the application of current between the corrector and the emitter. As a result, in the relay 112 the contact 112*a* is closed while the contact 112*b* is opened. Therefore, the counter electrode 4, thus connected to the toner carrier 20 through the resistor 113, comes to have the bias potential $E_1$ of the toner carrier 20.

Generally, when the power source for supplying voltages is in the non-operational state, a potential of the counter electrode 4 as well as that of the toner carrier 20 are unstable, due to the above-mentioned problem of the output impedance of the power source in the non-operational state. Therefore, in the image forming apparatus of the present embodiment, the counter electrode 4 is connected to the toner carrier 20 all the time except when the image formation is carried out. Accordingly, when the image formation is not carried out, the counter electrode 4 has the same potential as the toner carrier 20 has, which is therefore stable. As a result, the flight and scattering of the toner 18 from the toner carrier 20 when the image formation is not carried out is suppressed. Therefore, it is possible to prevent the toner 18 from adhering to the counter electrode 4 thereby dirtying sheets, and to prevent inadequate control of the flight of toner 18.

Note that a lead switch may substitute for the relay 112 in the switching circuit 111.

[Seventh Embodiment]

Figure 26:
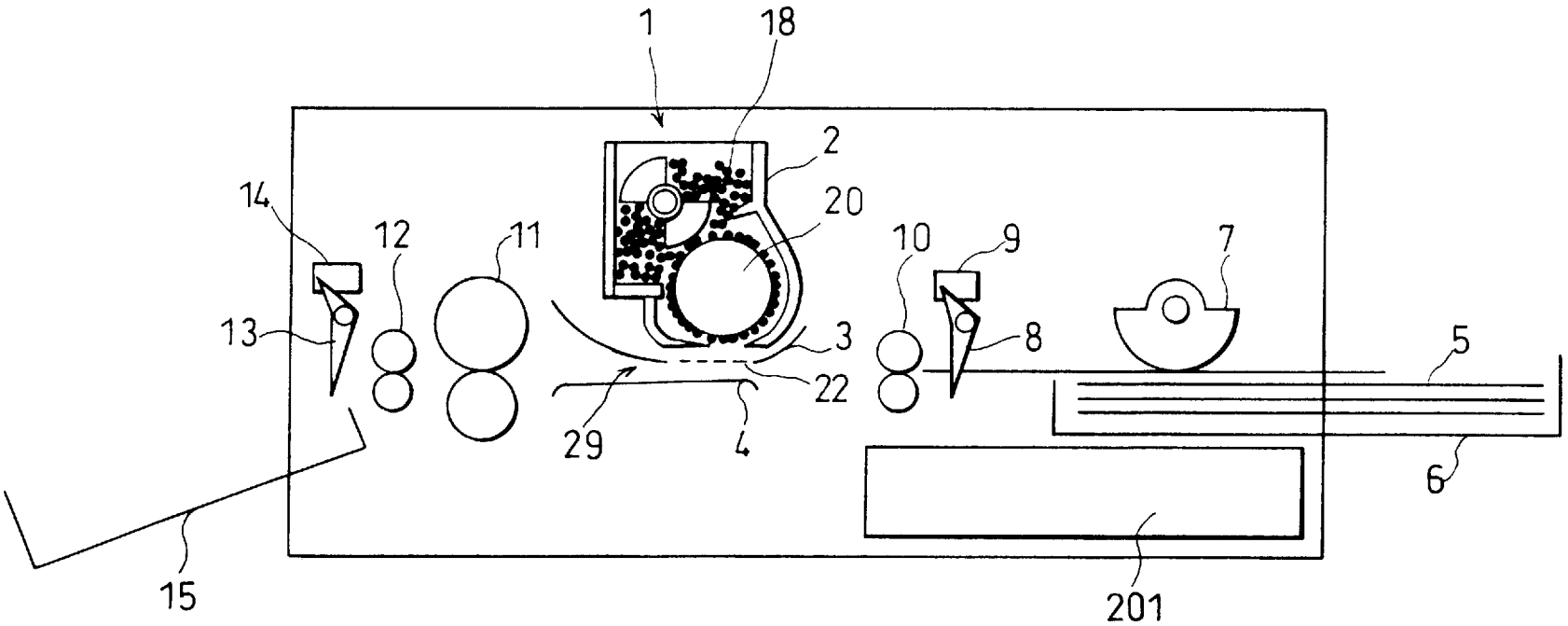
FIG. 26 is a view illustrating an arrangement of a whole image forming apparatus in accordance with still another embodiment of the present invention.
Figure 27:
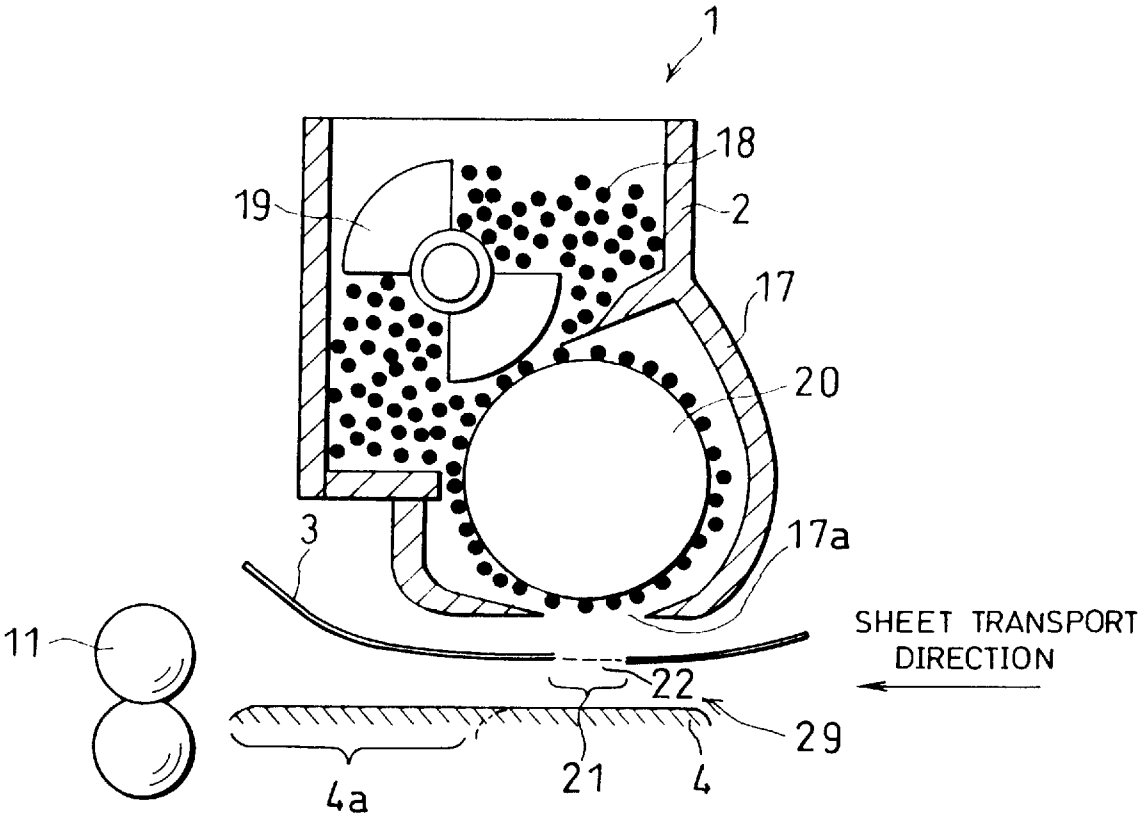
FIG. 27 is a schematic front view illustrating the arrangement of the image forming unit provided in the image forming apparatus illustrated in FIG. 26.
Figure 28:
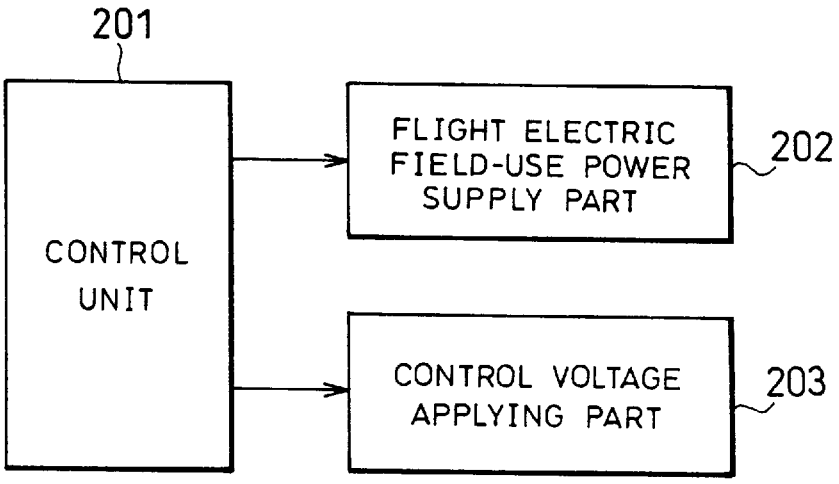
FIG. 28 is a block diagram illustrating voltage applying parts for applying voltages to the image forming unit of the image forming apparatus illustrated in FIG. 26, and a control unit for controlling the voltage applying parts.

The following description will discuss still another embodiment of the present invention, with reference to FIGS. 26 through 28. The members having the same structure (function) as those in the above-mentioned embodiment will be designated by the same reference numerals and their description will be omitted.

An image forming apparatus of the present embodiment has a plate-shaped counter electrode 4 as shown in FIGS. 26 and 27. A control electrode 22 and the counter electrode 4 are provided so that the surfaces thereof are parallel. A sheet 5 is transported along a sheet transport route 29 between the control electrode 22 and the counter electrode 4 so that the sheet 5 contacts the surface of the counter electrode 4.

The control electrode 22 may have any of the configuration shown in FIG. 6, that shown in FIG. 8 and FIG. 7(*b*) which is a cross-sectional view of the configuration of FIG. 8, and that shown in FIG. 10 and FIG. 9(*b*) which is a cross-sectional view of the configuration of FIG. 10. Note that a cross-sectional view of the configuration shown in FIG. 6 is shown in FIG. 5(*b*). Furthermore note that insulating substrates are omitted in FIGS. 6, 8, and 10. The configurations of the control electrode 22 are as described above.

The counter electrode 4 includes an extension section 4*a*, as shown in FIG. 27. The extension section 4*a* is provided at least on the downstream side of a portion facing the image forming region 21 of the sheet transport direction, and extends in the sheet transport direction. In the present embodiment, the extension section 4*a* is provided only on the downstream side of the sheet transport direction, with a downstream-side section of the counter electrode 4 longer than an upstream-side section of the same. The extension section 4*a* is arranged so as to have a length two times as long as that of a main section of the counter electrode 4, the main section being a section from the upstream-side end of the counter electrode 4 to the point indicated by the broken line in the figure. The downstream-side end portion of the extension section 4*a* reaches in the vicinity of the fixing part 11. Besides, the downstream-side end portion of the extension section 4*a* extends farther in the sheet transport direction than the downstream-side end portion of the control electrode 22, so that it is prevented that an electric field generated by the control electrode 22 adversely affects the condition of the toner 18 held on a sheet 5. Note that the downstream-side end portion of the control electrode 22 is a portion including the leader lines 26 connected to the control grids 25, namely, a portion to which the control voltage is applied. In the present embodiment, the foregoing downstream-side end portion of the control electrode 22 is shown as an end portion of the image forming head 3 in FIG. 27. The length of the counter electrode 4 is set longer as the image forming apparatus has a higher speed of the image forming process.

The image forming apparatus of the present embodiment is provided with a control unit 201, a flight electric field-use power supply part 202, and a control voltage applying part 203, as shown in FIG. 28. The flight electric field-use power supply part 202 applies a voltage across the toner carrier 20 and the counter electrode 4, the voltage for generating an electric field which causes the toner 18 to fly from the toner carrier 20 to the counter electrode 4. The control voltage applying part 203 applies a control voltage to the control electrode 22 in accordance with an image signal. The operations of the described two members are controlled by the control unit 201.

The following description will discuss the image formation conducted by the image forming apparatus of the present embodiment which has the described arrangement, with reference to FIGS. 26 and 27. The sheet 5 is transported to the image forming region 21, as described in the first embodiment. In the next stage, the control voltage in accordance with the image signal is applied by the control voltage applying part 203 to the control electrode 22. At the same time, a voltage is applied by the flight electric field-use power supply part 202 across the toner carrier 20 and the counter electrode 4, thereby generating an electric field in a direction such that the toner 18 is caused to fly from the toner carrier 20 toward the counter electrode 4. As a result, the electric field in the vicinity of the image forming head 3 is controlled in accordance with the image signal, thereby causing a toner image to be formed, in accordance with the image signal, on the sheet 5. The sheet 5 is transported over the counter electrode 4 to the fixing part 11, by which the toner image on the sheet 5 is fixed thereto.

Here, the electric field of the counter electrode 4, among others, has the greatest influence on the toner 18 adhering to the sheet 5 in the space from the image forming region 21 to the fixing part 11. To be more specific, since a voltage of around 1 kV through 3 kV is applied to the counter electrode 4 in the image forming apparatus of the present embodiment, a ground terminal of the image forming apparatus, if being present around the counter electrode 4, may possibly generate an electric field which causes the toner 18 to move into between the ground terminal and the counter electrode 4. If the counter electrode 4 supplies an unsatisfactory amount of electric charges to the sheet 5, the toner 18 may possibly move due to the influence of the above-mentioned electric field.

To prevent such a phenomenon, it is necessary to supply a satisfactory amount of the electric charges to the sheet 5 by setting long enough the period of time for supplying the electric charges to the sheet 5. Therefore, in the image forming apparatus of the present embodiment, the period of time for supplying the electric charges from the counter electrode 4 to the sheet 5 is prolonged by providing the extension section 4*a* in the counter electrode 4, so that the supply of the electric charges from the counter electrode 4 to the sheet 5 is increased so as to prevent the movement of the toner 18 on the sheet 5. With this arrangement, images of high quality can be obtained.

According to the arrangement shown in FIG. 27, the extension section 4*a* is provided on the downstream side of the image forming region 21 of the sheet transport direction and reaches in the vicinity of the fixing part 11 thereby not allowing the electric charges held by the sheet 5 to decrease but increasing the supply of electric charges to the sheet 5. Therefore, the toner 18 caused to adhere to the sheet 5 in the image forming region 21 is maintained thereon until the toner 18 is fixed on the sheet 5 by the fixing part 11. Thus, the ability of keeping the toner 18 on the sheet 5 is enhanced.

Furthermore, since the downstream-side end of the extension section 4*a* extends farther in the sheet transport direction than the downstream-side end portion of the control electrode 22, the movement of the visualizing particles on the recording medium is more surely prevented.

More specifically, the voltage applied to the control electrode 22 is switched between a voltage for causing the toner 18 to fly and a voltage for suppressing the flight of the toner 18, in accordance with the image signal. Therefore, the toner 18 held on the sheet 5 is also affected by electric fields caused by these control voltages. But, by providing the extension section 4*a* of the counter electrode 4 so that the counter electrode 4 covers a space larger than a range which is affected by the electric fields caused by the control voltages, the toner 18 is hardly affected by the electric fields, resulting in that the movement of the toner 18 is suppressed.

[Eighth Embodiment]

Figure 29:
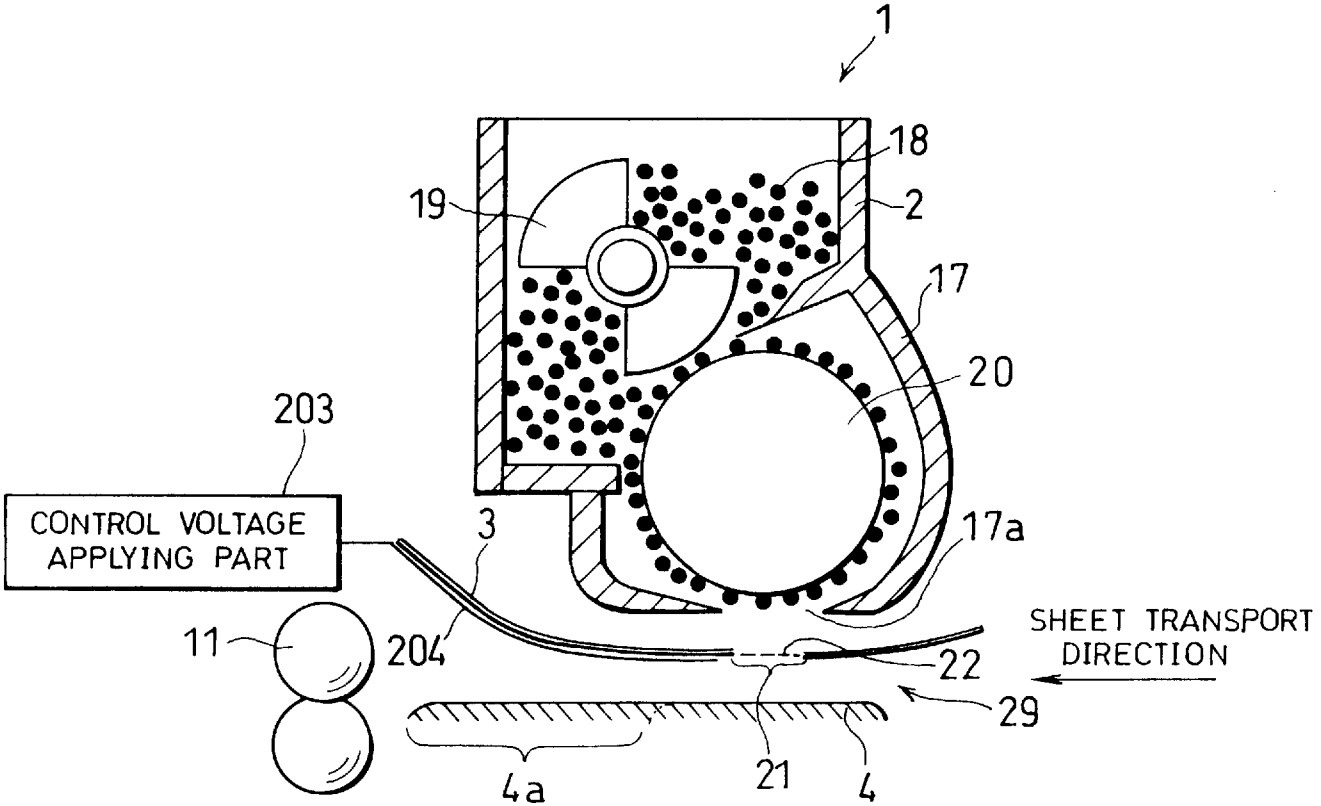
FIG. 29 is a schematic front view illustrating an arrangement of an image forming unit provided in an image forming apparatus in accordance with another embodiment of the present invention.
Figure 30A:
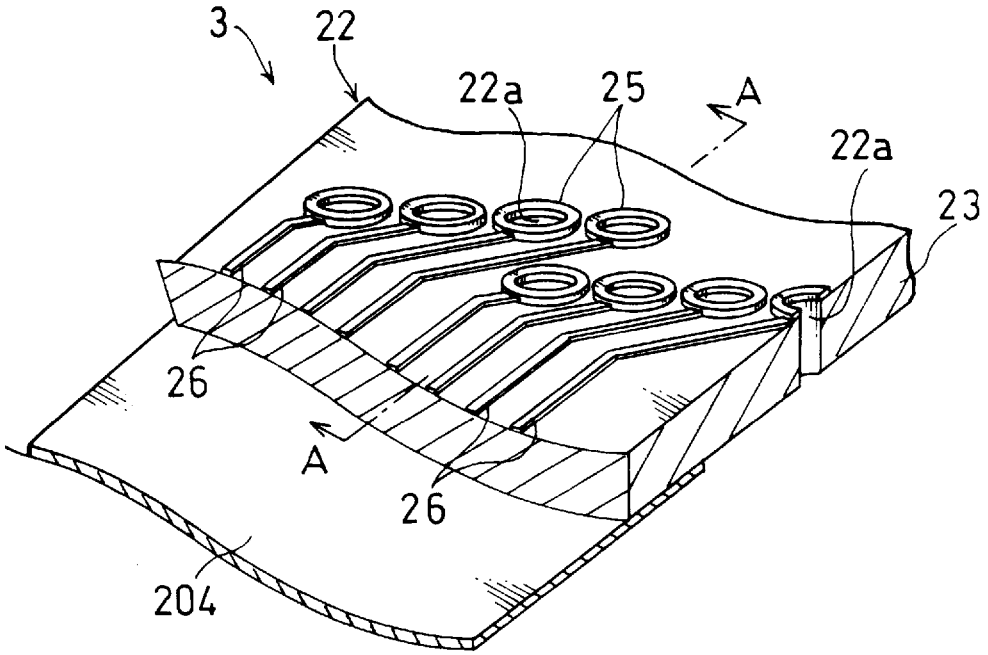
FIG. 30(*a*) is a perspective view illustrating a portion of the control electrode illustrated in FIG. 29, and FIG. 30(*b*) is a cross-sectional view of the portion illustrated in FIG. 30(*a*) when it is sectioned along the A—A arrow line.
Figure 30B:
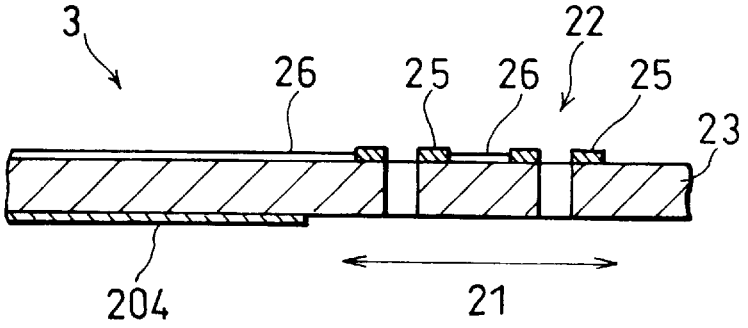

The following description will discuss another embodiment of the present invention, with reference to FIGS. 29 and 30. The members having the same structure (function) as those in the above-mentioned embodiment will be designated by the same reference numerals and their description will be omitted.

An image forming apparatus in accordance with the present embodiment has an image forming unit 1, which, as shown in FIG. 27, includes a shield plate 204 as a conductive shield member. The shied plate 204 is provided on the downstream side of an image forming region 21 in the sheet transport direction along the surface of an image forming head 3 which faces a counter electrode 4. The portion of the image forming head 3 facing the shield plate 204 corresponds to, for example, the portion where leader lines 26 are provided, the leader lines 26 for supplying a voltage to control grids 25 on the control electrode 22. The portion is shown in FIG. 30(*a*), and FIG. 30(*b*) which is a cross-sectional view obtained by cutting the image forming head 3 shown in FIG. 30 along the A—A line. Therefore, the voltage applied to the control grids 25 is also applied to the above-mentioned portion. Note that the shield plate 204 is provided on a surface of an insulating substrate 23, which is opposite to the surface where the control grids 25 are provided.

The shield plate 204 is connected to the control voltage applying part 203. During the image formation, a toner flight voltage as a control voltage for causing the toner 18 to fly from the toner carrier 20 to the counter electrode 4 is applied to the shield plate 204 by the control voltage applying part 203.

With the above arrangement wherein the shield plate 204 is provided in addition to the configuration shown in FIG. 27, the movements of the toner 18 on the sheet 5 is further surely prevented.

More specifically, as described above, the electric field caused by the counter electrode 4, among others in the space from the image forming region 21 to the fixing part 11, has the greatest influence on the toner 18 adhering to the sheet 5. However, since the control electrode 22 is closest to the counter electrode 4 and the control voltage which is switched between the toner flight voltage and the flight suppressing voltage is always applied to the control electrode 22, an electric field caused by the control electrode 22, which includes an electric field caused by the lead lines 26 for applying the control voltage to the control grids 25 in the control electrode 22, also has a comparatively great influence on the toner 18 adhering to the sheet 5. Therefore, by disposing as described above the shield plate 204 to which the toner flight voltage is applied by the control voltage applying part 203, the electric field generated by the leader lines 26 and others in the vicinity of the counter electrode 4 can be shielded, while at the same time a force can be applied to the toner 18 on the sheet 5 so that the toner 18 is pressed on the sheet 5. As a result, the movements of the toner 18 caused to adhere to the sheet 5 due to the image forming operation is more surely prevented.

Note that any voltage may substitute for the toner flight voltage so as to be applied to the shield plate 204, provided that the voltage generates an electric field which causes the toner 18 adhering to the sheet 5 to be pressed onto the sheet 5.

[Ninth Embodiment]

The following description will discuss another embodiment of the present invention with reference to FIGS. 31 through 34. The members having the same structure (function) as those in the above-mentioned embodiment will be designated by the same reference numerals and their description will be omitted.

Figure 31:
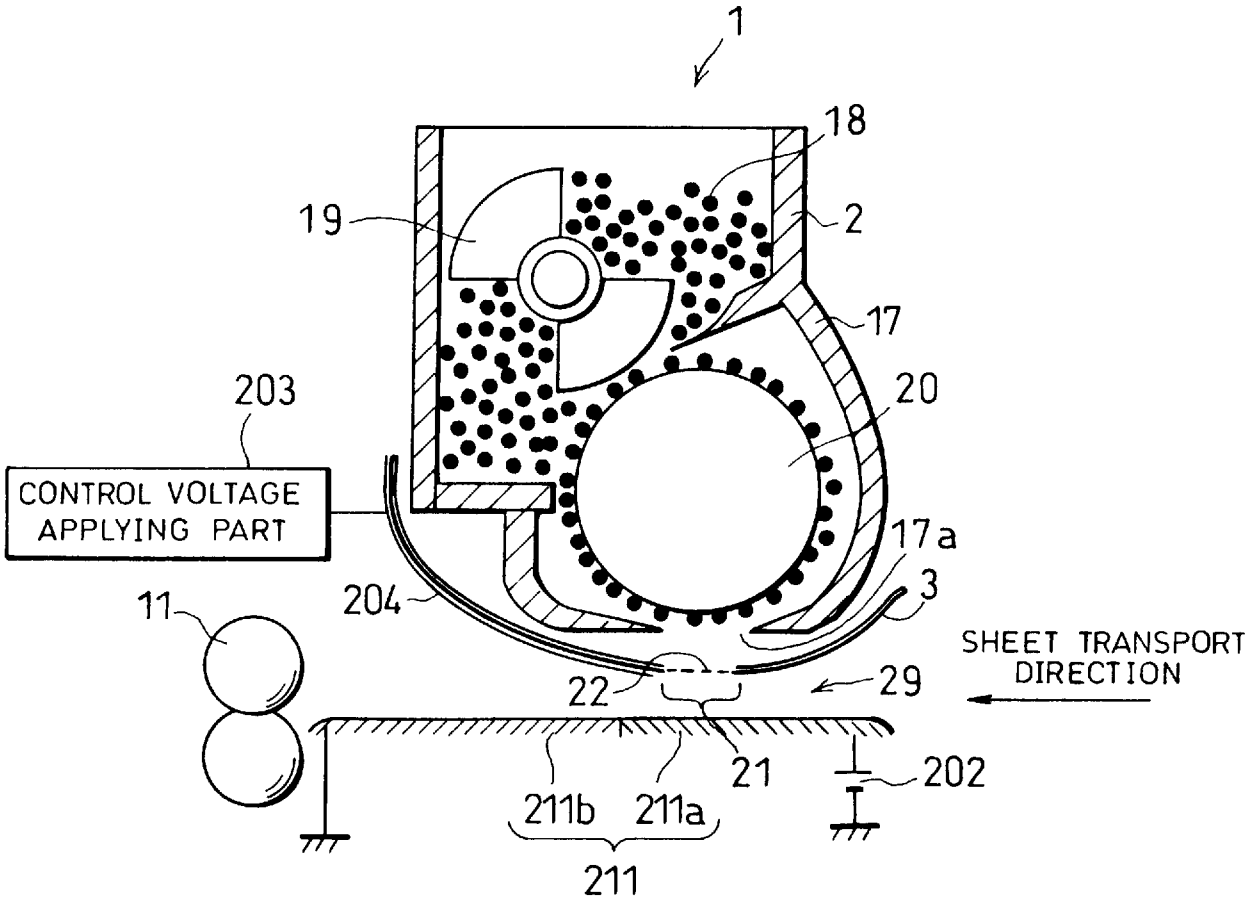
FIG. 31 is a schematic front view illustrating an arrangement of an image forming unit provided in an image forming apparatus in accordance with still another embodiment of the present invention.
Figure 32A:
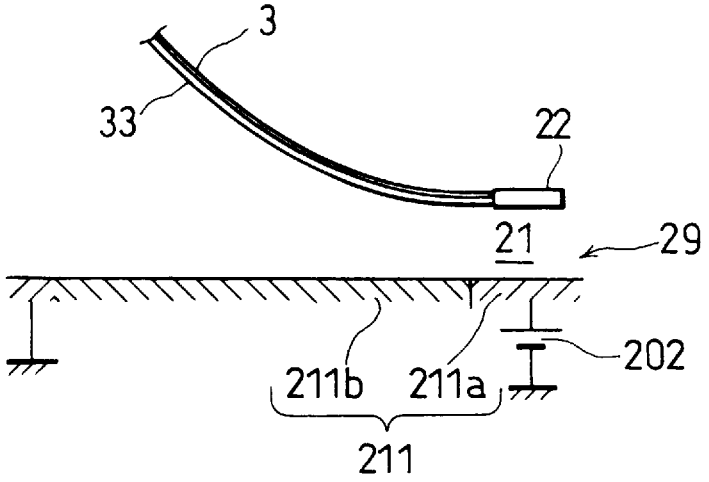
FIG. 32(*a*) is an enlarged view of a portion of the counter electrode illustrated in FIG. 31, and FIG. 32(*b*) is an equivalent circuit schematic of the portion of the counter electrode illustrated in FIG. 32(*a*).
Figure 32B:
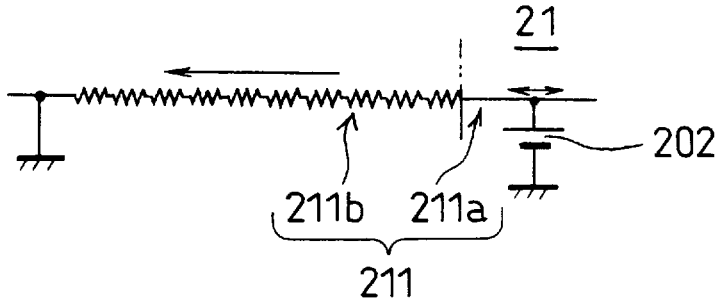

As shown in FIG. 31, an image forming apparatus of the present embodiment has an image forming unit 1 provided with a counter electrode 211 instead of the above-mentioned counter electrode 4. The counter electrode 211 has a conductive area 211a which is provided vis-a-vis the control electrode 22, and a high-resistive area 211*b* which is provided on the downstream side of the conductive area 211*a* in the sheet transport direction. An end portion of the high-resistive area 211*b* reaches in the vicinity of the fixing part 11. The other end portion of the high-resistive area 211*b* is electrically connected to the conductive area 211*a*. The conductive area 211*a* is connected to the flight electric field-use power supply part 202, while the downstream-side end portion of the high-resistive area 211*b* is connected to the ground terminal of the image forming apparatus. A view zooming in the arrangement around the counter electrode 211 is shown in FIG. 32(*a*), and an equivalent schematics of FIG. 32(*a*) is shown in FIG. 32(*b*).

A portion of the control electrode 22 corresponding to the image forming region 21 is disposed closer to the counter electrode 211 than the other part of the control electrode 22, especially a portion where the leader lines 26 are provided.

With the described arrangement, a predetermined voltage is applied by the flight electric field-use power supply part 202 across the conductive area 211*a* of the counter electrode 211 and the toner carrier 20 during the image formation, so that an electric field is generated between the toner carrier 20 and the conductive area 211*a*, the electric field causing the toner 18 to fly from the toner carrier 20 to the conductive area 211*a*. A control voltage in accordance with the image signal is applied to the control electrode 22, so that the flight of the toner 18 is controlled.

On the other hand, the sheet 5 is transported along the sheet transport route 29 on the counter electrode 211, with the surface of the rear surface of the sheet 5 in contact with the counter electrode 211. During the transport, the toner 18 flying from the toner carrier 20 adheres to the upward surface of the sheet 5, thereby forming a toner image. Thereafter, when an edge of the sheet 5 reaches the downstream-side end of the high-resistive area 211*b*, the sheet 5 comes off from the surface of the high-resistive area 211*b*, and is sent to the fixing part 11, by which the toner image on the sheet 5 is fixed thereon.

Figure 33:
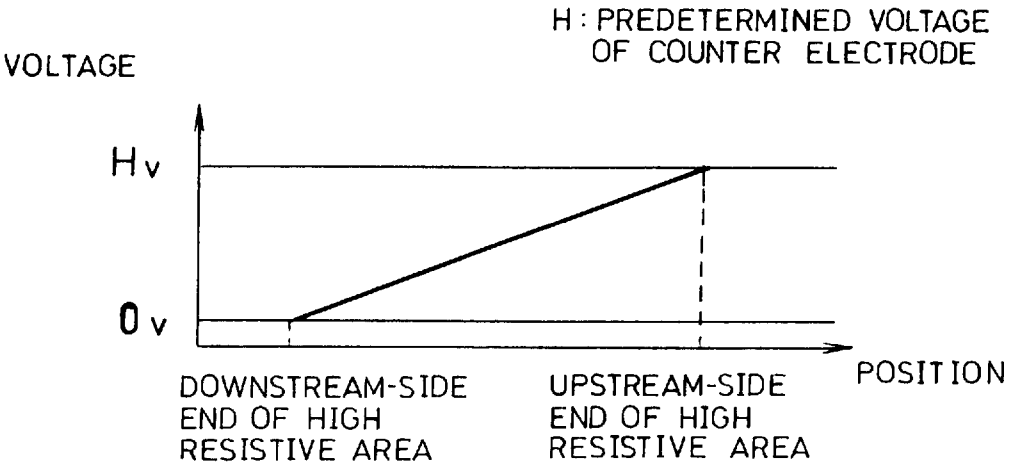
FIG. 33 is a graph illustrating potential gradation in the portion of the counter electrode illustrated in FIG. 32(*a*).
Figure 34:
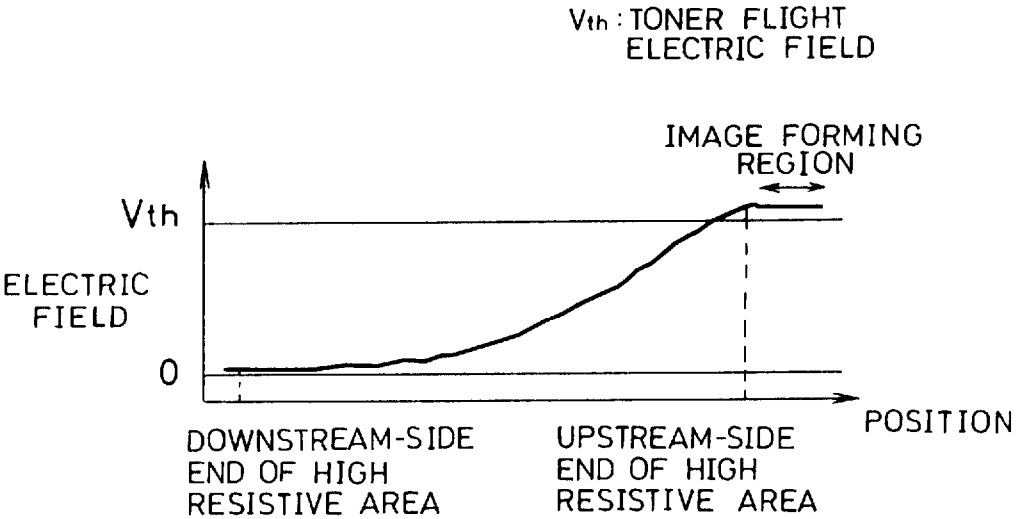
FIG. 34 is a graph illustrating strength gradation of an electric field around the counter electrode illustrated in FIG. 32(*a*).

More specifically, during the transport of the sheet 5 along the sheet transport route 29, electric charges are supplied to the rear surface of the sheet 5 by the counter electrode 211, and the toner 18 on the surface of the sheet 5 is held thereon, without moving, due to the electric charges. When a predetermined voltage is applied to the counter electrode 211 by the flight electric field-use power supply part 202, the conductive area 211*a* of the counter electrode 211 has a predetermined potential in accordance with the predetermined voltage. On the other hand, the high-resistive area 211*b* has a potential which, as shown in FIG. 33, gradually decreases as the voltage decreases from the upstream-side end to the downstream-side end, finally falling to the ground potential of the image forming apparatus at the downstream-side end portion. With such a gradation of the potential of the counter electrode 211, the electric field of the counter electrode 211 has a strength greater than that of the flight electric field in the image forming region 21, and the strength gradually falls from the upstream-side end to the downstream end of the high-resistive area 211*b*, as shown in FIG. 34. Therefore, when the sheet 5 comes off from the counter electrode 211 and is fed to the fixing part 11, an electric discharge does not occur between the sheet 5 and the counter electrode 211, thereby ensuring that movement of the toner 18 on the sheet 5 due to the shock of the discharge is avoided.

To be more specific, the electric charges applied by the counter electrode 211 to the rear surface of the sheet 5 contribute in keeping equilibrium with the electric charges of the toner 18 adhering to the surface of the sheet 5, and the potential of the sheet 5 as a whole becomes 0 V under the condition that sufficient electric charges are supplied to the sheet 5. Therefore, in the case where the downstream-side end portion of the high-resistive area 211*b* has the ground potential, which is 0 V, no potential difference occurs between the sheet 5 and the downstream-side end portion of the high-resistive area 211*b*, thereby causing no discharge between the two when the sheet 5 comes of f from the high-resistive area 211*b*. When a drastic change occurs in the potential of the counter electrode 211 thereby causing the downstream-side end portion of the counter electrode 211 to have a ground potential, a discharge may possibly occur due to the drastic change in the potential. In contrast, in the case where the potential of the conductive area 211*a* gradually decreases in the high-resistive area 211*b*, finally to the ground potential at the downstream-side end portion of the high-resistive area 211*b*, namely, the downstream-side end portion of the counter electrode 211, such a problem as described above by no means occurs.

In addition, since the portion of the control electrode 22 corresponding to the image forming region 21 is disposed closer to the counter electrode 211 than the other portions thereof, especially than the portion where the leader lines 26 are provided, changes in the potential of the control electrode 22 during the image formation affects only the image forming region 21, and the changes are not allowed to cause any distortion in the electric field in the vicinity of the sheet 5. Therefore, the foregoing arrangement ensures that the toner 18 adhering to the sheet 5 is well maintained, thereby ensuring that images of high quality are obtained. Note that this arrangement is applicable to the image forming apparatus of the other embodiments.

With the foregoing arrangement, the movement of the toner 18 caused by the shocks of the discharge during the transport of the sheet 5 along the sheet transport route 29 can be prevented, thereby ensuring that images of high quality are obtained.

Furthermore, with the above-described simple arrangement wherein the conductive area 211*a* and the high-resistive area 211*b* are provided in the counter electrode 211, an area for the image formation which has a predetermined potential, and an area which has a potential gradually decreasing from the upstream side to the downstream side are both provided in the counter electrode 211.

[Tenth Embodiment]

The following description will discuss still another embodiment of the present invention with reference to FIGS. 35 through 38. The members having the same structure (function) as those in the above-mentioned embodiment will be designated by the same reference numerals and their description will be omitted.

Figure 35:
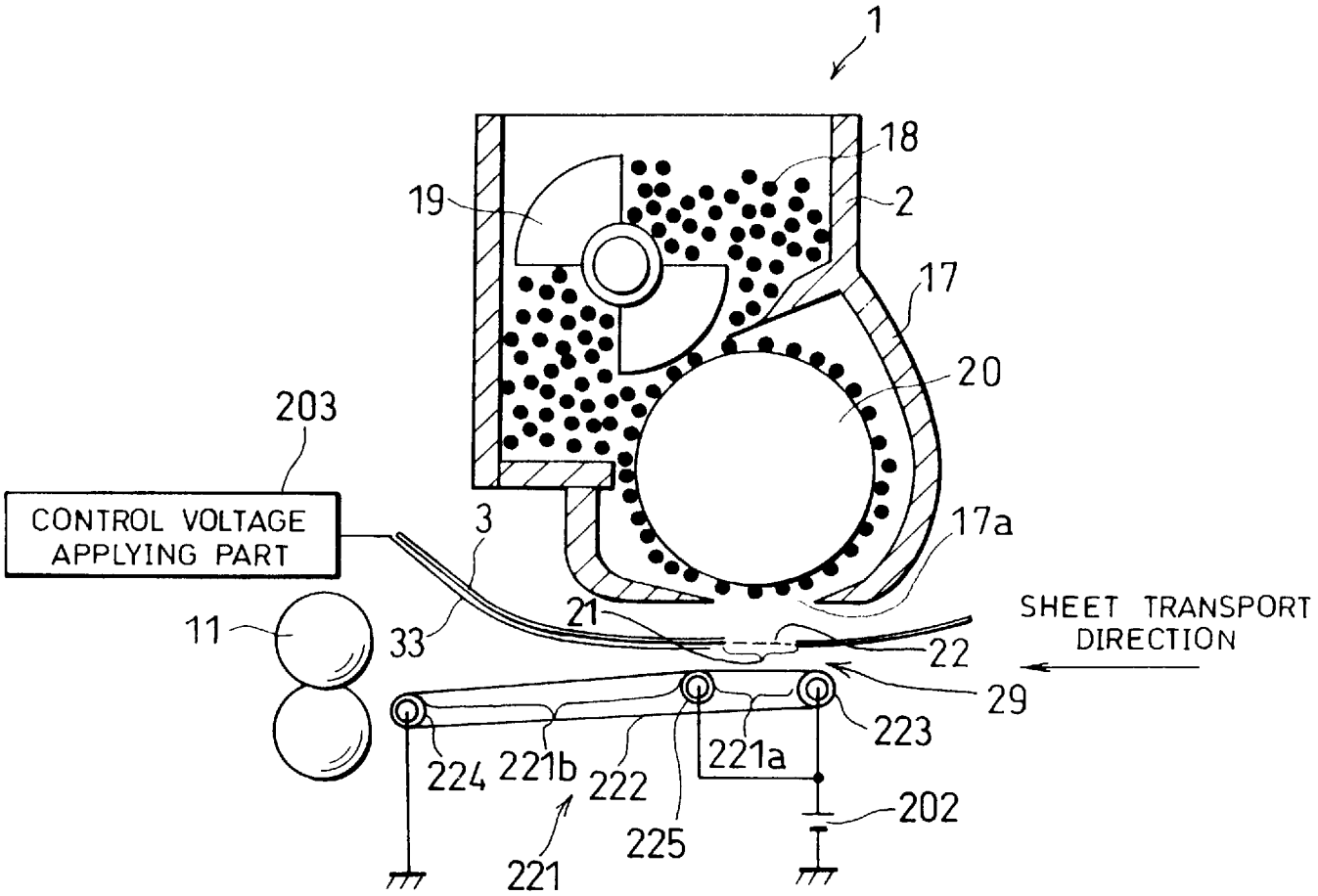
FIG. 35 is a schematic front view illustrating an arrangement of an image forming unit provided in an image forming apparatus in accordance with still another embodiment of the present invention.

As shown in FIG. 35, an image forming apparatus of the present embodiment has an image forming unit 1, which is provided with a counter electrode 221 instead of the counter electrode 4 of the foregoing embodiments. The counter electrode 221 is provided with an endless resistive belt 222, and first through third conductive rollers 223 through 225 which support the conductive belt 222. The first through third conductive rollers 223 through 225 are lined up in the sheet transport direction. The first conductive roller 223 is disposed on the upstream side of the sheet transport direction, while the second conductive roller 224 on the downstream side, so as to rotatably support the resistive belt 222. The third conductive roller 225 is provided between the first conductive roller 223 and the second conductive roller 224, so that the third conductive roller 225 contacts the rear surface of the resistive belt so that a section between the first and third conductive rollers 223 and 225 faces the region where the sheet transport is carried out (hereinafter referred to as sheet transport section). A part of the sheet transport section of the resistive belt 222 which is between the first conductive roller 223 and the third conductive roller 225 is provided parallel to the control electrode 22, while the other part of the sheet transport section of the resistive belt 222, which is between the third conductive roller 225 and the second conductive roller 224, is inclined so that the second conductive roller 224 is lower than the third conductive roller 225.

Figure 36:
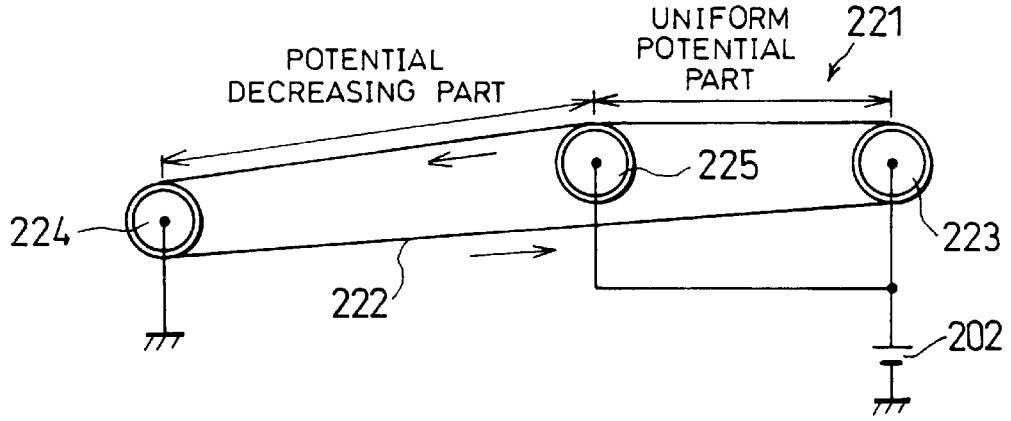
FIG. 36 is an enlarged view illustrating the counter electrode illustrated in FIG. 35.

As shown in FIG. 36, the first and third conductive rollers 223 and 225 are connected to the flight electric field-use power supply part 202 of the above-described embodiments, while the second conductive roller 224 is connected to the ground terminal of the above-described embodiments, which is provided in the image forming apparatus. Therefore, when a predetermined counter electrode voltage is applied to the first conductive roller 223 and the third conductive roller 225 by the flight electric field-use power supply part 202 during the image formation, the part of the resistive belt 222 between the first conductive roller 223 and the third conductive roller 225, namely, the part corresponding to the image forming region 21, becomes a uniform potential section 221*a*, which has a uniform potential causing the flight electric field. On the other hand, the part between the third and second conductive rollers 225 and 224 becomes a potential decreasing section 221*b*, which has a potential gradually decreasing from the third conductive roller 225 to the second conductive roller 224 and finally falling to the ground potential.

With the described arrangement, as is the case with the image forming apparatus of the third embodiment, no discharge is caused between the sheet 5 and the counter electrode 221 when the sheet 5 comes off from the counter electrode 221 and is fed to the fixing part 11. Therefore, since it is avoided that the toner 18 on the sheet 5 moves due to the shock of a discharge, it is ensured that images of excellent quality are obtained.

Figure 37:
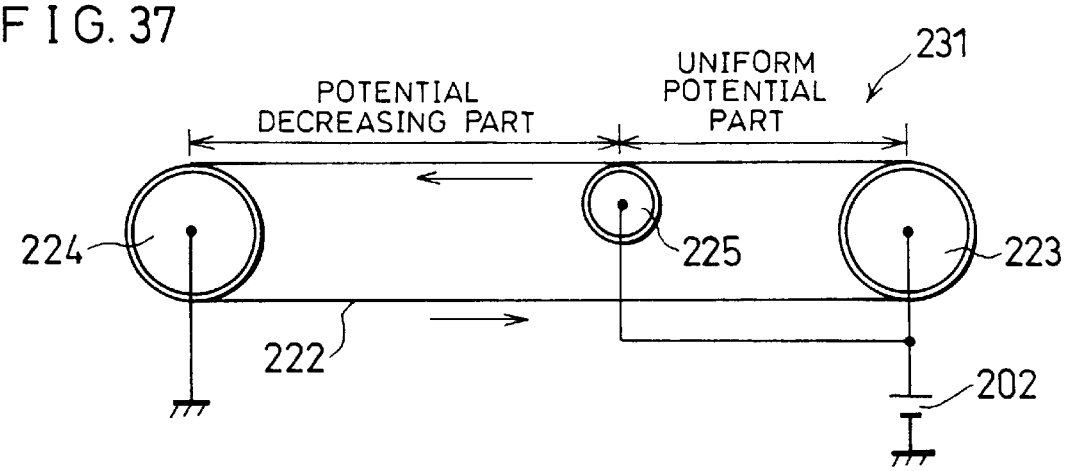
FIG. 37 is a front view illustrating another example of the counter electrode illustrated in FIG. 36.

Note that the counter electrode 221 may have the same arrangement as that of the counter electrode 61 of FIG. 37. In the counter electrode 61, the first and second conductive rollers 223 and 224 have the same diameter, while the third conductive roller 225 has a smaller diameter. With the described arrangement, it is not necessary to incline the resistive belt 222 in the potential decreasing region. It is possible to dispose the resistive belt 222 horizontally through the uniform potential section and the potential decreasing section.

Figure 38:
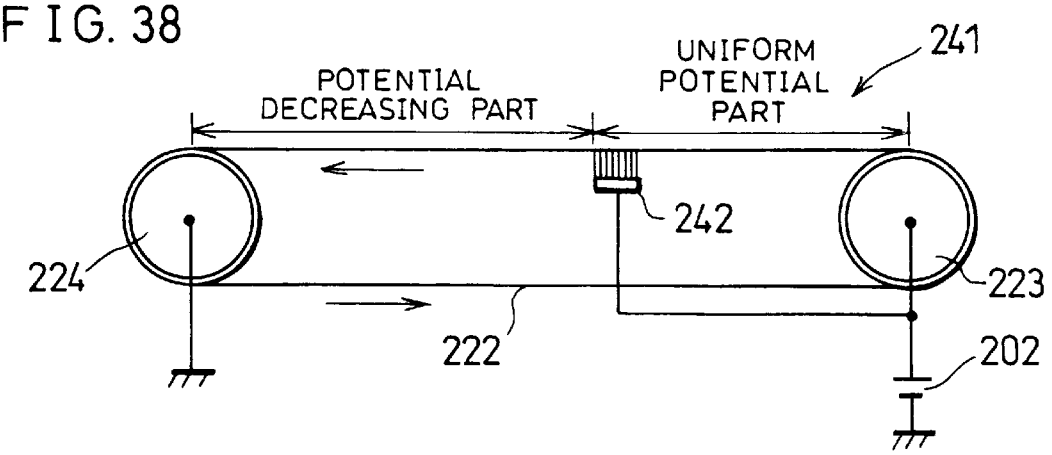
FIG. 38 is a front view illustrating still another example of the counter electrode illustrated in FIG. 36.

Furthermore, the counter electrode 221 may have the same arrangement as that of the counter electrode 241 of FIG. 38. A conductive brush 242 is provided in the counter electrode 2 41 in t he place of the third conductive roller 225, so that the conductive brush 242 is provided in contact with the rear surface of the resistive belt 222.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a visualizing particle carrier for carrying visualizing particles;

a counter electrode provided vis-à-vis said visualizing particle carrier;

a control electrode provided between said visualizing particle carrier and said counter electrode;

power supply means for applying a flight electric field-use voltage across said visualizing particle carrier and said counter electrode so that an electric field for causing the visualizing particles to fly from said visualizing particle carrier toward said counter electrode is generated;

control voltage applying means for applying a control voltage to said control electrode so that the flight of the visualizing particles is controlled in accordance with an image signal; and control means for controlling said power supply means and said control voltage applying means, so that during an operational period while the flight electric field-use voltage and control voltage are applied, said visualizing particle carrier, said counter electrode, and said control electrode are first respectively set to have a bias potential, the bias potential being set to have the electric potential of said counter electrode and a polarity of said counter electrode during application of the flight electric field-use voltage.

2. An image forming apparatus as set forth in claim 1, wherein, during a non-operational period while the flight electric field-use voltage and the control voltage are not applied, said control means causes each of said visualizing particle carrier, said counter electrode, and said control electrode to have a ground potential of said image forming apparatus.

3. An image forming apparatus as set forth in claim 1, further comprising:

cleaning means for removing foreign material adhering to a surface of said counter electrode; and cleaning process control means for causing a foreign material flying electric field to be generated at least either before image formation starts or after the image formation ends, the electric field causing foreign material adhering to said control electrode to fly toward said counter electrode.

4. The image forming apparatus as set forth in claim 3, wherein said cleaning process control means applies an alternating voltage to said counter electrode so that the electric field is generated.

5. The image forming apparatus as set forth in claim 4, wherein the alternating voltage has a peak value set to the potential of said counter electrode when the flight electric field-use voltage is applied, and a bottom value set not higher than a ground potential of the image forming apparatus.

6. The image forming apparatus as set forth in claim 3, wherein, when the foreign material flying electric field is generated both before and after the image formation, said cleaning process control means controls the foreign material flying electric field so that the electric field is generated for a longer period after the image formation than before the image formation.

7. An image forming apparatus as set forth in claim 1, further comprising:

a recording medium transport route through which a recording medium is transported while being in contact with said counter electrode, the recording medium transport route being provided between said control electrode and said counter electrode, the visualizing particles adhering to the recording medium; and charging removing means for removing electric charges of said control electrode.

8. The image forming apparatus as set forth in claim 7, wherein said charge removing means removes the electric charges before the image formation.

9. The image forming apparatus as set forth in claim 7, wherein:

said control electrode includes an insulating layer, a plurality of gates provided in said insulating layer, and a plurality of electrode sections, each electrode section being provided around each gate, visualizing particles being allowed to pass through said gates, the control voltage being applied to said electrode sections;

said charge removing means includes a resistive layer and a connecting circuit, said resistive layer being provided on at least one surface of said insulating layer, said connecting circuit electrically connecting or disconnecting said resistive layer to an object so that electric charges of said resistive layer are released through the object during connecting; and said resistive layer has a limited resistance such that a surface resistance of said resistive layer is smaller than that of said insulating layer and that a time constant derived from the surface resistance of said resistive layer and a capacitance between the electrode sections is greater than a voltage control cycle of said control electrode.

10. The image forming apparatus as set forth in claim 9, wherein said connecting circuit connects or disconnects said resistive layer to said visualizing particle carrier.

11. The image forming apparatus as set forth in claim 9, wherein said connecting circuit connects or disconnects said resistive layer to a ground terminal of said image forming apparatus.

12. The image forming apparatus as set forth in claim 9, wherein said resistive layer is provided in contact with said electrode sections.

13. The image formation apparatus as set forth in claim 7, wherein:

said control electrode includes an insulating layer, a plurality of gates in said insulating layer and a plurality of electrode sections, each electrode section being provided around each gate, visualizing particles being allowed to pass through said gates, the control voltage being applied to said electrode sections;

said charge removing means includes a resistive layer, said electrode sections being provided on said resistive layer; and said resistive layer has a limited resistance such that a surface resistance of said resistive layer is smaller than that of said insulating layer and that a time constant derived from the surface resistance of said resistive layer and a capacitance between the electrode sections is greater than a voltage control cycle of said control electrode.

14. The image forming apparatus as set forth in claim 7, wherein:

said control electrode includes an insulating layer, a plurality of gates provided in said insulating layer, and a plurality of electrode sections, each electrode section being provided around each gate, visualizing particles being allowed to pass through said gates, the control voltage being applied to said electrode sections; and said charge removing means includes:

a photoconductive layer provided on at least one surface of said insulating layer, said photoconductive layer having a resistance decreasing upon receipt of light, a connecting circuit for electrically connecting or disconnecting said photoconductive layer to an object so that electric charges of said photoconductive layer are released through the object during connecting, and a light source for projecting the light on said photoconductive layer.

15. The image forming apparatus as set forth in claim 14, wherein said connecting circuit connects or disconnects said photoconductive layer to said visualizing particle carrier.

16. The image forming apparatus as set forth in claim 14, wherein said photoconductive layer is provided in contact with said electrode sections.

17. The image forming apparatus as set forth in claim 7, wherein:

said control electrode includes a plurality of gates and a plurality of electrode sections, each electrode section being provided around each gate, visualizing particles being allowed to pass through said gates, the control voltage being applied to said electrode sections; and said charge removing means includes a photoconductive layer on which said electrode sections are provided, and a light source for projecting light on said photoconductive layer.

18. An image forming apparatus as set forth in claim 1, further comprising:

a connecting circuit for connecting said visualizing particle carrier to a ground terminal of said image forming apparatus through a resistor with a limited resistance; and switching means, provided in said connecting circuit, for switching said connecting circuit so as to connect said visualizing particle carrier to the ground terminal when no voltage is applied to said visualizing particle carrier, while disconnecting when a voltage is applied to said visualizing particle carrier.

19. An image forming apparatus as set forth in claim 1, further comprising:

a connecting circuit for connecting said visualizing particle carrier to said counter electrode through a resistor with a limited resistance; and switching means, provided in said connecting circuit, for switching said connecting circuit so as to connect said visualizing particle carrier to said counter electrode when said flight electric field-use voltage is not applied to said visualizing particle carrier, while disconnecting when said flight electric field-use voltage is applied to said visualizing particle carrier.

20. The image forming apparatus as set forth in claim 1, wherein said control means controls said power supply means and said control voltage applying means, so that during an operational period while the flight electric field-use voltage and the control voltage are applied, a flight suppressing voltage in the control voltages is first applied to said control electrode, the flight suppressing voltage for suppressing the flight of the visualizing particles, and thereafter the flight electric field-use voltage is applied across said visualizing particle carrier and said counter electrode.

21. The image forming apparatus as set forth in claim 20, wherein said control means control said power supply means and said control voltage applying means, so that, when the application of the flight electric field-use voltage and the control voltage is suspended, the flight suppressing voltage as the control voltage is applied to said control electrode, then the application of the flight electric field-use voltage is suspended, and thereafter the application of the flight suppressing voltage is suspended.

22. An image forming apparatus as set forth in claim 1, further comprising a recording medium transport route through which a recording medium is transported while being in contact with said counter electrode, the recording medium transport route being provided between said control electrode and said counter electrode, the visualizing particles adhering to the recording medium.

* * * * *